US011203093B2

(12) United States Patent
Naderer

(10) Patent No.: US 11,203,093 B2
(45) Date of Patent: Dec. 21, 2021

(54) CHANGING STATION FOR THE AUTOMATIC CHANGING OF GRINDING MATERIALS

(71) Applicant: FerRobotics Compliant Robot Technology GmbH, Linz (AT)

(72) Inventor: Ronald Naderer, Oberneukirchen (AT)

(73) Assignee: FERROBOTICS COMPLIANT ROBOT TECHNOLOGY GMBH, Linz (AT)

( * ) Notice: Subject to any disclaimer, the term of this patent is extended or adjusted under 35 U.S.C. 154(b) by 432 days.

(21) Appl. No.: 16/091,324

(22) PCT Filed: Apr. 3, 2017

(86) PCT No.: PCT/EP2017/057862
§ 371 (c)(1),
(2) Date: Oct. 4, 2018

(87) PCT Pub. No.: WO2017/174512
PCT Pub. Date: Oct. 12, 2017

(65) Prior Publication Data

US 2019/0152015 A1 May 23, 2019

(30) Foreign Application Priority Data

Apr. 4, 2016 (DE) ..... 102016106141.7

(51) Int. Cl.
*B24B 27/00* (2006.01)
*B24D 9/08* (2006.01)

(52) U.S. Cl.
CPC ..... *B24B 27/0038* (2013.01); *B24D 9/085* (2013.01)

(58) Field of Classification Search
CPC ... B24B 27/0038; B24B 23/005; B24B 23/02; B24B 13/005; B24B 13/0057;
(Continued)

(56) References Cited

U.S. PATENT DOCUMENTS 5,231,803 A * 8/1993 Lanzer ..... B24B 23/03 451/28
6,264,534 B1 * 7/2001 Panyard ..... B24B 19/26 451/11

(Continued)

FOREIGN PATENT DOCUMENTS

DE 202013101858 U1 * 5/2013 ..... B25J 11/0065
WO 2015125068 A1 8/2015
WO WO-2015125068 A1 * 8/2015 ..... B24B 23/03

*Primary Examiner* — Joseph J Hail
*Assistant Examiner* — Michael A Gump
(74) *Attorney, Agent, or Firm* — Murphy, Bilak & Homiller, PLLC

(57) ABSTRACT

An apparatus includes a frame, a separating plate connected to the frame, a sensor aimed at the separating plate, and a support surface connected to the frame. The separating plate and the support surface are coupled with the frame so as to allow for a relative movement between the separating plate and the support surface in a first direction. The separating plate and the support surface are arranged such that when a grinding disc rests against the support surface and when the separating plate and the grinding disc move towards each other, at least one first edge of the separating plate is pushed over grinding disc. The sensor is arranged such that when the separating plate is pushed over the grinding disc, the grinding disc is between the sensor and the separating plate.

8 Claims, 13 Drawing Sheets

(58) Field of Classification Search
CPC ..... B24B 37/34; B24B 45/00; B24B 45/003; B24B 45/006; B24B 49/12; B24D 9/085; B24D 9/08; B25J 11/0065; B25J 19/02; B25J 19/021
USPC ..... 451/5, 357, 360, 444, 458
See application file for complete search history.

(56) References Cited

U.S. PATENT DOCUMENTS

| | | | | |
|---|---|---|---|---|
| 7,144,313 | B1 | 12/2006 | Greenwood | |
| 2004/0048549 | A1* | 3/2004 | Beaudoin | B24D 9/08 451/5 |
| 2012/0142255 | A1* | 6/2012 | Panergo | B24B 27/0038 451/28 |
| 2015/0020369 | A1* | 1/2015 | Ryan | B25H 3/006 29/467 |
| 2015/0328734 | A1* | 11/2015 | Multhammer | B24B 27/0038 483/1 |
| 2016/0039067 | A1* | 2/2016 | Bonnet | B24B 23/046 451/67 |
| 2017/0066106 | A1* | 3/2017 | Bosio | B24B 27/0038 |
| 2019/0001460 | A1* | 1/2019 | Staubli | B24B 27/0038 |

* cited by examiner

CHANGING STATION FOR THE AUTOMATIC CHANGING OF GRINDING MATERIALS

TECHNICAL FIELD

This disclosure relates to a changing station that enables a robot-supported grinding apparatus to automatically change grinding materials (e.g. grinding discs).

BACKGROUND

Grinding machines such as, e.g. orbital grinding machines, are employed in industries and skilled trades for numerous purposes. Orbital grinding machines are grinding machines in which a rotational movement around an axis of rotation is superimposed over an oscillation movement (vibration). They are frequently used for the final processing of surfaces when high demands are placed on the quality of the finished surface. In order to fulfill these demands, to the greatest possible extent irregularities should be prevented during the grinding process. In practice and when smaller numbers of units are manufactured, this is generally achieved by having these tasks carried out by experienced skilled workers.

In robot-supported grinding apparatuses, a grinding tool (e.g. an orbital grinding machine) is guided by a manipulator, for example, an industrial robot. The grinding tool can be coupled with the so-called TCP (tool center point) of the manipulator in various ways, allowing the manipulator to set the tool to virtually any position and orientation. Industrial robots are generally position-controlled, making it possible to move the TCP precisely along a desired trajectory. In many applications it is necessary to control the processing force (grinding force) in order to obtain good results in a robot-supported grinding process, and this is often difficult to achieve with the needed degree of precision using common industrial robots. The large and heavy arm segments of an industrial robot possess too much inertia for a controller (closed-loop controller) to be able to react quickly enough to variations in the processing force. In order to solve this problem, a smaller (as compared to industrial robots) linear actuator can be arranged between the TCP of the manipulator and the grinding tool to couple the TCP of the manipulator with the grinding tool. The linear actuator only controls the processing force (here the pressing force between the tool and the workpiece) while the manipulator moves the grinding tool, together with the linear actuator, position-controlled along a specifiable trajectory.

Grinding machines such as, e.g. orbital grinding machines, operate with thin, flexible and removable grinding discs that are attached to a backing pad. The grinding disc may be made, for example, of paper (or any other fiber-reinforced material) with a grained abrasive coating and can be attached to the backing pad, e.g. by means of a hook and loop or Velcro fastener. Even in robot-supported grinding devices, worn grinding discs are generally changed manually. Various concepts for robot-supported changing stations for changing grinding discs do exist, but the known solutions are relatively complex, require a great deal of effort to be realized and are therefore costly. For example, the publication EP 2 463 056 A2 describes a robot-supported grinding machine with an apparatus for the automated removal of used grinding discs as well as a method for the automated mounting of new grinding discs. The inventor, however, recognized several deficits of this and other apparatuses and methods in some applications (e.g. in orbital grinding).

The inventor identified a need for improved apparatuses and corresponding methods for the removal of grinding discs from a grinding machine and the mounting of grinding discs onto a grinding machine.

SUMMARY

An apparatus for automatically attaching a grinding disc onto a grinding machine of a robot-supported grinding apparatus is described. In accordance with one embodiment, the apparatus comprises a support for receiving a stack of grinding discs and a frame. The frame is arranged essentially parallel to the support so that the stack of grinding discs is positioned between the support and the frame, wherein the frame only partially overlaps the outer rim of the uppermost grinding disc of the stack. The apparatus further comprises a mechanical pretensioning unit that is coupled with the frame such that a defined force is exerted by the frame onto the stack of grinding discs.

Further, an apparatus for automatically removing a grinding disc from a robot-supported grinding apparatus with a grinding machine is described. In accordance with one embodiment the apparatus comprises a frame, a separating plate connected to the frame and a support surface connected to the frame. The separating plate and the support surface are coupled with the frame such that a relative movement in a first direction between the separating plate and the support surface is possible. The separating plate and the support surface are arranged such that—when the grinding disc rests against the support surface and the separating plate and the grinding disc move towards each other—a first edge of the separating plate is pushed over the grinding disc.

Further, a method for automatically removing a grinding disc from a robot-supported grinding apparatus is described. In accordance with one embodiment, the method includes pressing a grinding disc against a support surface that is arranged essentially parallel to a separating plate and carrying out a relative movement between the separating plate and the support surface such that the separating plate and the support surface move towards each other until the separating plate enters a space between the grinding disc and a backing pad on which the grinding disc is mounted. Afterwards, the backing pad is lifted from the support surface, thereby removing the grinding disc from the backing pad.

Still further, a method for automatically mounting a grinding disc onto a robot-supported grinding apparatus is described. In accordance with one embodiment, the method includes aligning a backing pad of a grinding machine by means of a manipulator such that the underside of the backing pad is essentially parallel to the topside of a stack of grinding discs. The method further comprises pressing the backing pad against the stack of grinding discs by means of an actuator that is coupled between the manipulator and the grinding machine such that the topmost grinding disc of the stack of grinding discs adheres to the backing pad. Afterwards, the grinding machine is lifted, together with the grinding disc, by means of the manipulator and/or the actuator.

Finally, a system for changing grinding discs of a robot-supported grinding apparatus is described. In accordance with one embodiment, the system comprises the following: an apparatus with a frame and a separating plate for removing a grinding disc from a grinding machine, a manipulator that is configured to position the grinding machine relative to the separating plate and to move the grinding machine. In doing so, the relative movement of the grinding machine and the separating plate during removal of the grinding disc is effected solely by the manipulator. The apparatus with the frame and separating plate for removing a grinding disc does not require its own drive.

In accordance with a further embodiment, the system comprises a hopper for receiving a stack of grinding discs, a manipulator that is configured to position the grinding machine relative to the hopper and to move the grinding machine and an actuator (20) that is arranged between the grinding machine and the manipulator and that is configured to press the grinding machine against the topmost disc of the stack of grinding discs. When doing so, the relative movement between the grinding machine and the hopper is carried out solely by the manipulator or by the manipulator and the actuator (20).

SHORT DESCRIPTION OF THE FIGURES

Various embodiments are described in the following in greater detail using the examples illustrated in the figures. The figures are not necessarily true to scale and the invention is not limited to the illustrated aspects. Instead importance is given to illustrating the underlying principles of the embodiments described herein. The figures show:

FIG. 1 schematically shows an example of a robot-supported grinding apparatus.

FIG. 2 schematically shows the grinding tool and the grinding disc, as well as the attachment of the grinding disc onto the grinding tool.

FIG. 3 shows an isometric illustration of a grinding machine with a linear actuator for controlling the processing force.

FIGS. 4A-E show a first example of an apparatus for automatically removing a grinding disc from the grinding tool of FIG. 3, as well as the employment of the apparatus, which does not require its own drive.

FIGS. 5A-C show the same example of FIGS. 4A-E, wherein the removal process of the grinding disc is shown in greater detail.

FIGS. 6A-E show a further example of an apparatus for automatically removing a grinding disc from the grinding tool of FIG. 3, as well as the employment of the apparatus, which also does not require its own drive.

FIGS. 7A-D show a second example of an apparatus for automatically removing a grinding disc from the grinding tool of FIG. 3, as well as the employment of the apparatus, wherein the latter has a separate drive.

FIGS. 8A-B show the alignment of the angulation of the grinding disc in the case of an orbital grinding machine.

DETAILED DESCRIPTION

Figure 1:
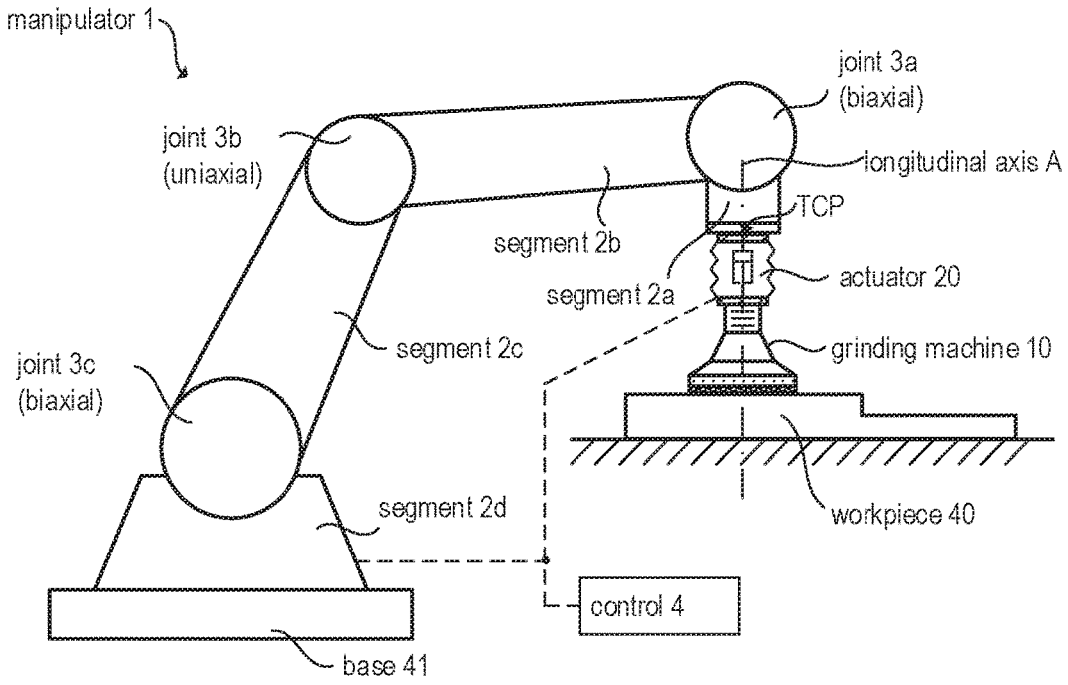

Before various embodiments are described in detail, an example of a robot-supported grinding apparatus will be described first. This comprises a manipulator 1, for example an industrial robot, and a grinding machine 10 with a rotating grinding tool (e.g. an orbital grinding machine), wherein the grinding tool is coupled with the so-called tool center point (TCP) of the manipulator 1 via a linear actuator 20. In the case of an industrial robot having six degrees of freedom, the manipulator may consist of four segments 2*a*, 2*b*, 2*c* and 2*d*, each of which is connected via the joints 3*a*, 3*b* and 3*c*. The first segment is generally rigidly connected to a base 41 (which, however, need not necessarily be the case). The joint 3*c* connects the segments 2*c* and 2*d*. The joint 3*c* can be biaxial and may allow for a rotating movement of the segment 2*c* around a horizontal axis of rotation (elevation angle) and a vertical axis of rotation (azimuth angle). The joint 3*b* connects the segments 2*b* and 2*c* and allows a swivel movement of the segment 2*b* relative to the position of the segment 2*c*. The joint 3*a* connects the segments 2*a* and 2*b*. The joint 3*a* may be biaxial, thereby allowing (similar to joint 3*c*) for a swivel movement in two directions. The TCP is at a stationary position relative to segment 2*a*, wherein the latter generally also comprises a pivot joint (not shown) that allows for a rotational movement around the long axis of segment 2*a* (designated in FIG. 1 with a dot-dashed line, corresponds to the rotational axis of the grinding tool). An actuator is assigned to each axis of a joint that can effect a rotational movement around the respective joint axis. The actuators in the joints are controlled by a robot controller 4 in accordance with a robot program.

The manipulator 1 is generally position-controlled, i.e. the robot controller can determine the pose (position and orientation) of the TCP and move it along a predefined trajectory. In FIG. 1 the long axis of segment 2*a* on which the TCP lies is designated as A. When the actuator 20 rests against an end stop, the pose of the TCP also defines the pose of the grinding tool. As mentioned early on, the actuator 20 serves to adjust the contact force (processing force) between tool (grinding machine 10) and workpiece 40 to a desired value during the grinding process. Controlling the force directly with the manipulator 1 is generally too imprecise for grinding applications, as the high inertia present in the segments 2*a-c* of the manipulator 1 renders a speedy compensation of force peaks (e.g. when the grinding tool contacts the workpiece 40) using commonly known manipulators virtually impossible. For this reason the robot controller is configured to control the pose of the TCP of the manipulator, whereas the force control is carried out exclusively by the actuator 20.

As mentioned earlier, using the (linear) actuator 20 and a force controller (which, for example, can be implemented in the controller 4), the contact force FK between tool (grinding machine 10) and workpiece 40 can be adjusted such that the contact force (in the direction of the long axis A) between grinding tool and workpiece 40 corresponds to a specifiable desired value. Here the contact force is a reaction to the actuator force with which the linear actuator 20 presses against the workpiece surface. When there is no contact present between workpiece 40 and tool, as a response to this absence of contact force on the workpiece 40, the actuator 20 moves up to an end stop. The position controller of the manipulator 1 (which may also be implemented in the controller 4) can operate fully independently of the force controller of the actuator 20. The actuator 20 is not responsible for the positioning of the grinding machine 10, but only for adjusting and maintaining the desired contact force during the grinding process and for detecting contact between tool and workpiece. The actuator can be a pneumatic actuator, e.g. a double-acting pneumatic cylinder.

Other pneumatic actuators, however, may also be employed such as, e.g. bellow cylinders and air muscles. Direct (gearless) electric drives may also be considered as an alternative. It should be noted that the effective direction of the actuator 20 need not necessarily concur with the long axis A of segment 2*a* of the manipulator.

In the case of a pneumatic actuator, the force can be controlled in a known way using control valves, a controller (implemented in the controller 4) and a compressed air reservoir. The specific implementation, however, is of no relevance to the further description and will therefore not be discussed further here.

Figure 2:
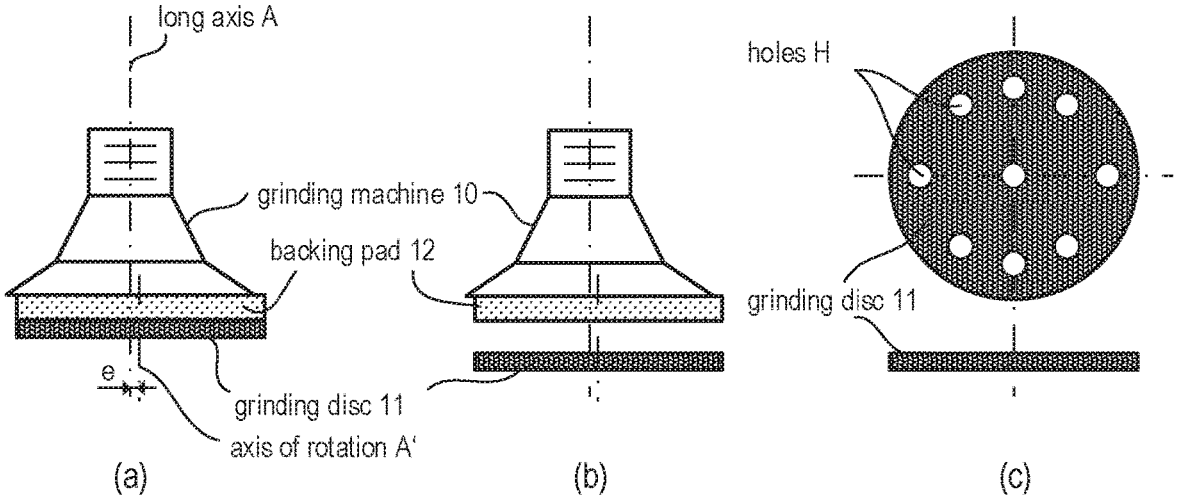

The grinding machine 10 has a grinding disc 11 that is mounted on a backing pad 12. The top surface of the backing pad 12, or the underside of the top surface of the grinding disc 11, or both surfaces have been structured to enable the grinding disc 11 and the backing pad 12 to easily adhere to each other. For example, a hook and loop fastener may be employed to securely adhere the grinding disc 11 to the backing pad 12. A releasable snap-in connection or similar might also be considered. FIG. 2(*a*) shows the grinding machine 10 with a mounted grinding disc 11. The grinding machine 10 is, in the present case, an orbital grinding machine in which the backing pad 12 is driven together with the grinding disc 11 via an eccentric bearing. Thus the axis of rotation A exhibits an eccentricity e that corresponds to the distance between the axes A and A'. When in operation, the backing pad is driven by an electric motor of the grinding machine 10 and the grinding disc 11 rotates together with the backing pad 12. In the case of an orbital grinding machine, the backing pad 12 carries out a more complex movement, namely a rotation around two parallel axes of rotation with a defined axis offset. The grinding disc 11 is made, for example, of paper (or any other fiber-reinforced material) with a grained abrasive coating, is flexible (bendable) and can be removed from the backing pad. FIG. 2(*b*) shows the grinding machine 10 with the grinding disc 11 removed. The grinding disc 11 (as well as the backing pad 12) may have holes H through which the grinding dust can be extracted. An example of a grinding disc with holes is shown, e.g. in FIG. 2(*c*). Both the holes H and the eccentricity e of the grinding disc can cause problems during the mounting of new grinding discs, as both the angulation of the backing pad 12 (and thus also the position of the holes H) relative to the axis of rotation A', as well as the angulation of the angle of rotation A' relative to the long axis A (symmetry axis) are not a priori defined. It may also happen that mounting a new grinding disc fails without the robot controller detecting the error, as a result of which the robot may attempt to grind the workpiece without the grinding disc 11 and in doing so may destroy the backing pad 12.

Figure 3:
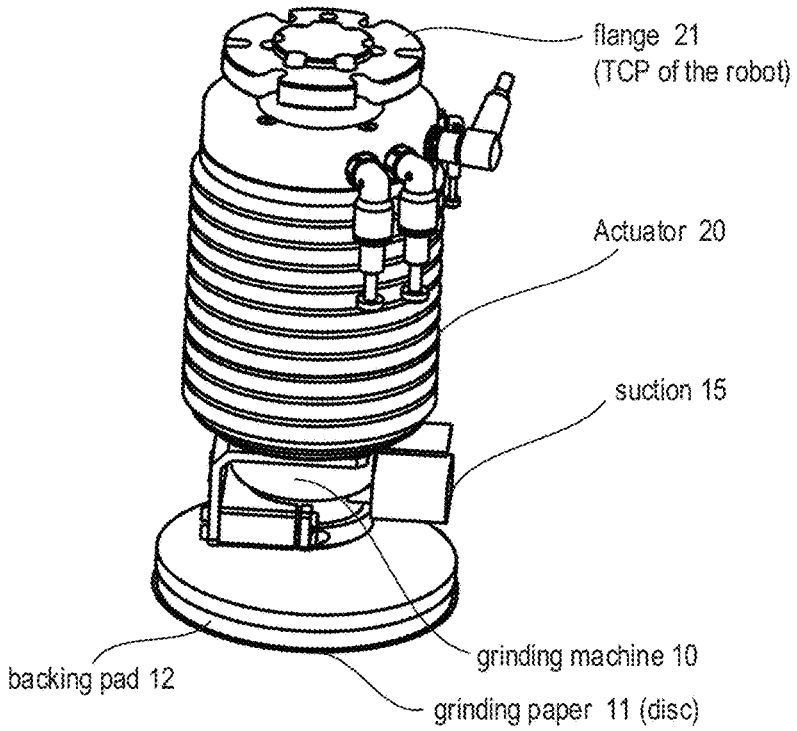

In FIG. 3 a further example of a grinding machine 10 mounted on an actuator 20 is illustrated. The actuator 20 comprises a first flange 21 that may be rigidly connected to the manipulator 1 (e.g. segment 2*a* in FIG. 1). The TCP of the manipulator can lie, e.g. in the middle of the flange 21. At the opposite end of the actuator 20 there is a second flange (covered in FIG. 3) on which the grinding machine 10 is mounted. In FIG. 3, e.g. the connection 15 for a tube through which the dust is suctioned off is also shown. Despite the automation of the grinding process using robot-supported grinding apparatuses, grinding discs are still frequently changed by hand, whereby an operator grasps the rim of the grinding disc 11 using thumb and index finger and pulls it off the backing pad. Existing automatic solutions for automatically changing the grinding discs are relatively complex, this complexity arising, for example, from the need for the grinding disc 11 to be grasped by a mechanical apparatus before it is pulled off. In FIGS. 4A-4E, 5A-4C and 6A-4E various embodiments of apparatuses are illustrated by means of which grinding discs can be automatically removed from a grinding machine. In FIGS. 7A-D an apparatus is shown that can be used to automatically connect grinding discs to the backing pad of a grinding machine of a robot-supported grinding apparatus.

The illustrations in FIGS. 4A to 4D show the apparatus of FIG. 3 (grinding machine 10 with actuator 20) and an example of a removal apparatus 2 for removing the grinding disc 11 from the grinding machine 10 in various situations during the removal of the grinding disc 11. In accordance with the example shown in FIGS. 4A-E, the apparatus for removing a grinding disc from a grinding machine with a rotating grinding disc comprises a frame 31, a separating plate 32 connected to the frame, as well as a support surface that is also connected to the frame 31. The separating plate 32 and the support surface are coupled with the frame 31 to allow for a relative movement between the separating plate 32 and the support surface 33 in a first direction (see FIG. 4A, direction x). In the present example, the support surface is a roller track 33. Pins 39 may be arranged on the frame whose purpose will be explained further below with reference to FIGS. 8A-B.

The roller track 33 is made up of numerous axes 35 arranged parallel to each other. One or more rollers 34 are arranged on each axis such that they can rotate around the corresponding axis (see FIGS. 4B and 4C). The length of the axes 35 corresponds approximately to the width of the roller track 33. The two ends of each axis are mechanically connected to the frame, in the present example the axes 35 are firmly clamped (e.g. using screws) on the frame 31 using a clamping component (clamp 36). The individual rollers 34 can be mounted on the axes by means of a roller bearing or a slide bearing. The frame 31 and, consequently, the roller track 33, are wide enough so that a grinding machine 10 that is connected to a manipulator 1 (see FIG. 1) can be pressed against the support surface (defined by the roller track 33) until the grinding disc 11 mounted on the grinding machine rests against the support surface. The flat grinding disc 11 then lies approximately parallel to the axes 35. Pressing the grinding machine against the support surface defined by the roller track 33 is carried out, e.g. by the actuator 20, which also allows controlling the contract force between the roller track 33 and the grinding disc 11. Here, as opposed to during the grinding process, an exact controlling of the contact force is not absolutely necessary.

The rollers 34 of the roller track 33 allow the grinding machine 10 to be moved, together with the grinding disc 11, in the direction x (towards the separating plate 32). This shifting movement of the grinding disc along the roller track 33 is determined by the manipulator 1. Neither the rollers 34 nor the separating plate 32 require a separate drive. While the grinding disc 11 is being moved in the direction x towards the separating plate 32, the rollers 34 rotate due to the rolling friction between the rollers 34 and the grinding disc 11. Thanks to this rotational movement of the rollers 34, a material abrasion of the roller track 33 is largely prevented.

Figure 4A:
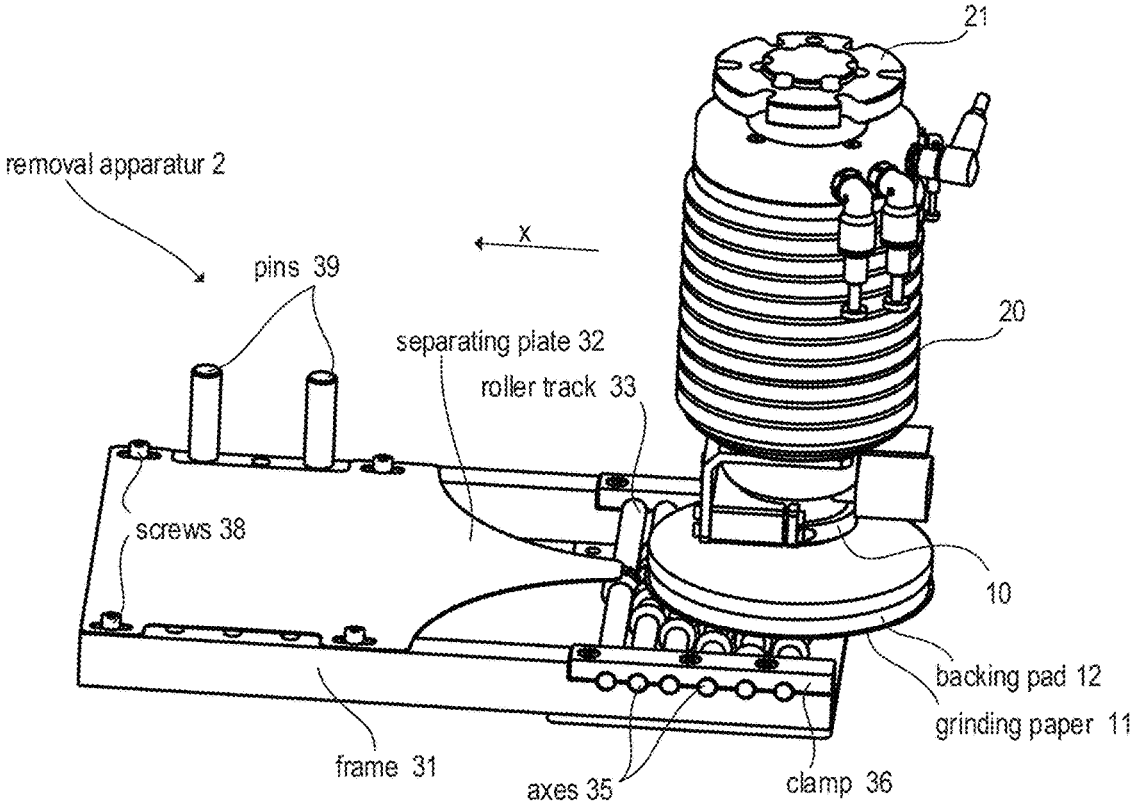
Figure 4B:
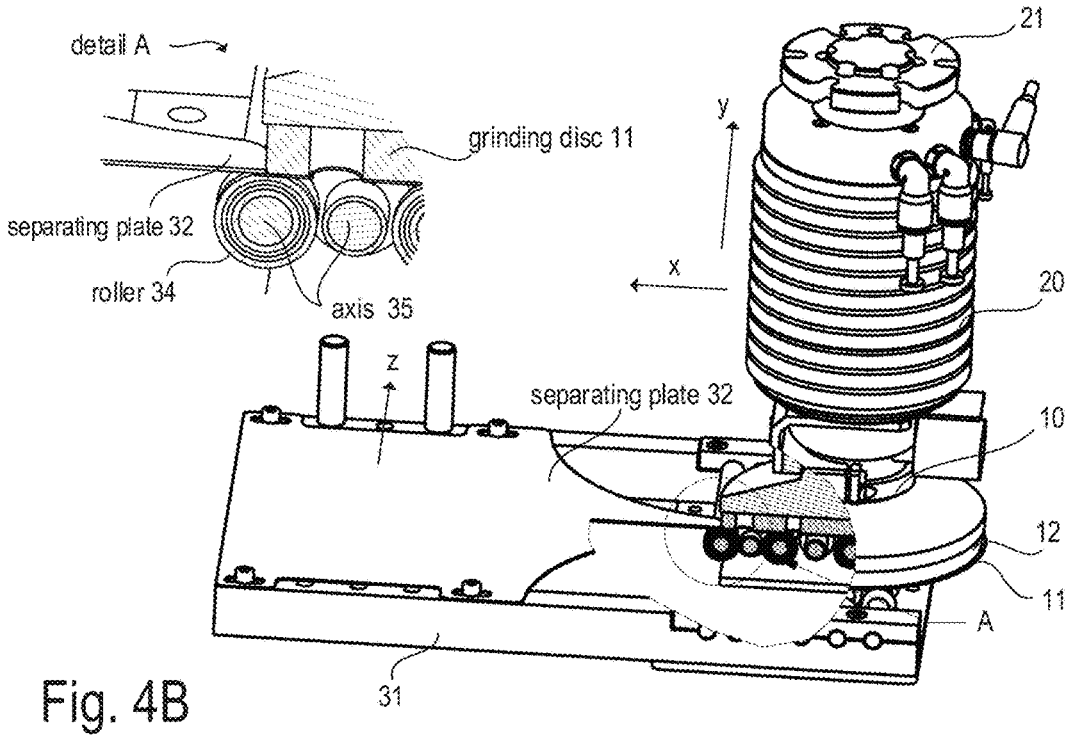
Figure 4C:
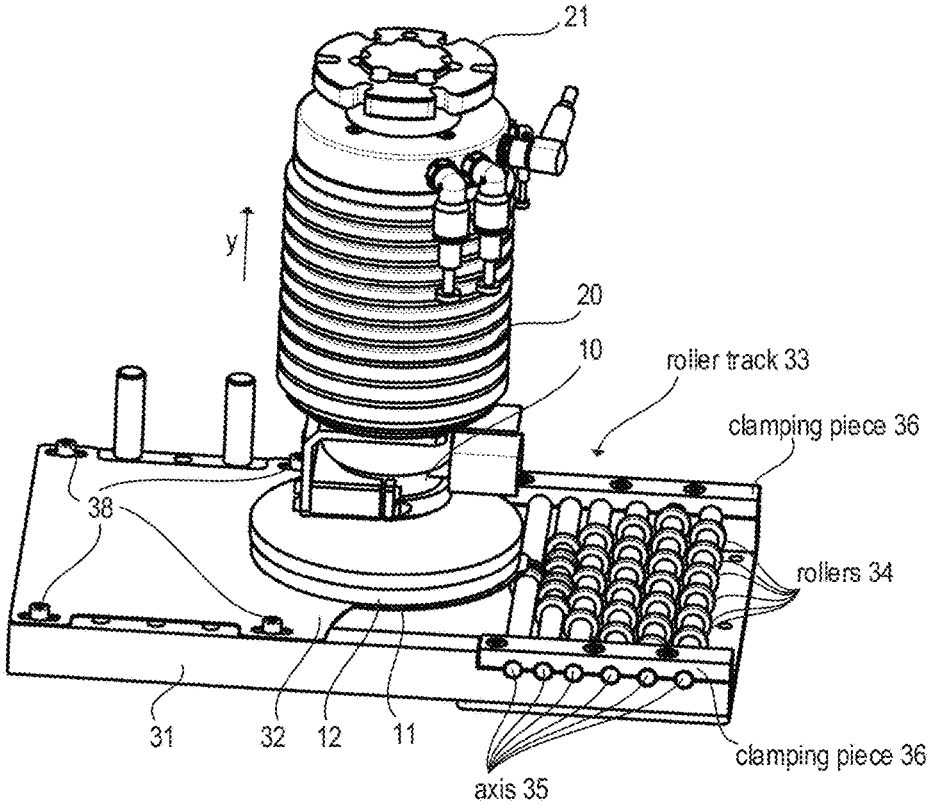
Figure 4D:
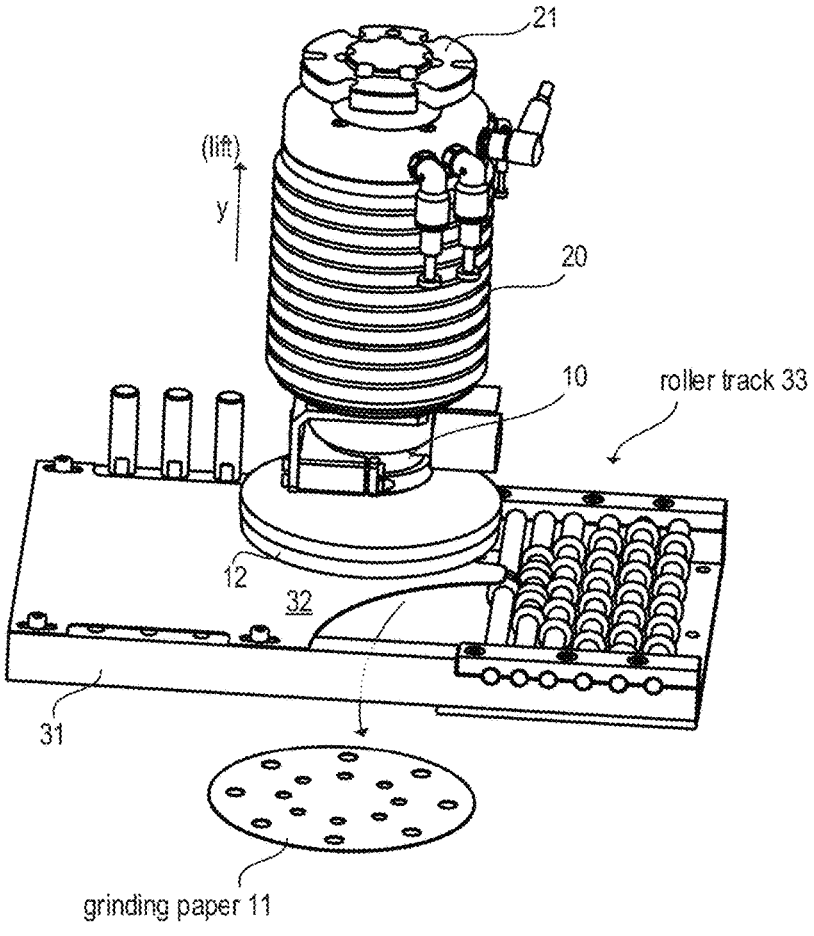

FIG. 4B shows the beginning of a grinding disc removal process. As mentioned earlier, the manipulator 1 moves the grinding machine along the roller track 33 towards the separating plate 32. The separating plate 32 is arranged relative to the roller track 33 such that—when the grinding machine 10 with the grinding disc 11 is pressed against the roller track 33—an edge of the separating plate 32 is inserted between the grinding disc 11 and the backing pad 12 releasing the bond between the two parts (grinding disc 11 and backing pad 12). In the case of a hook and loop fastener between the grinding disc 11 and the backing pad 12, the fastener is gradually opened as the separating plate 32 is inserted between the grinding disc 11 and the backing pad 12. In the detailed view A of FIG. 4B, a situation is illustrated in which the separating plate 32 is shown just before being inserted into the space between the grinding disc 11 and the backing pad 12 as the grinding machine 10 is moved towards the separating plate 32 along the roller track 33. In FIG. 4C a situation is illustrated in which the separating plate 32, following in the direction of movement of the grinding machine 10 (direction x), has been almost entirely inserted into the space between the grinding disc 11 and the backing pad 12. An adhesive bond between the grinding disc 11 and the backing pad 12 is now only present locally in the areas near the edge of the grinding disc.

After the separating plate 32 has been inserted far enough into the space between the grinding disc 11 and the backing pad 12 to release the greater part of the adhesive bond between the grinding disc 11 and the backing pad 12, the grinding machine 10 can be lifted off of the separating plate 32 (in the direction y, see FIG. 4D), thereby removing the grinding disc 11 completely from the backing pad 12 and causing it to fall off (due to gravitational force). The removal process of the grinding disc is thereby completed and the grinding machine 10 is ready to receive a new grinding disc 11. The lifting movement of the grinding machine 10 in the y direction may be effected either by the actuator 20 or the manipulator 1 (or both).

Figure 4E:
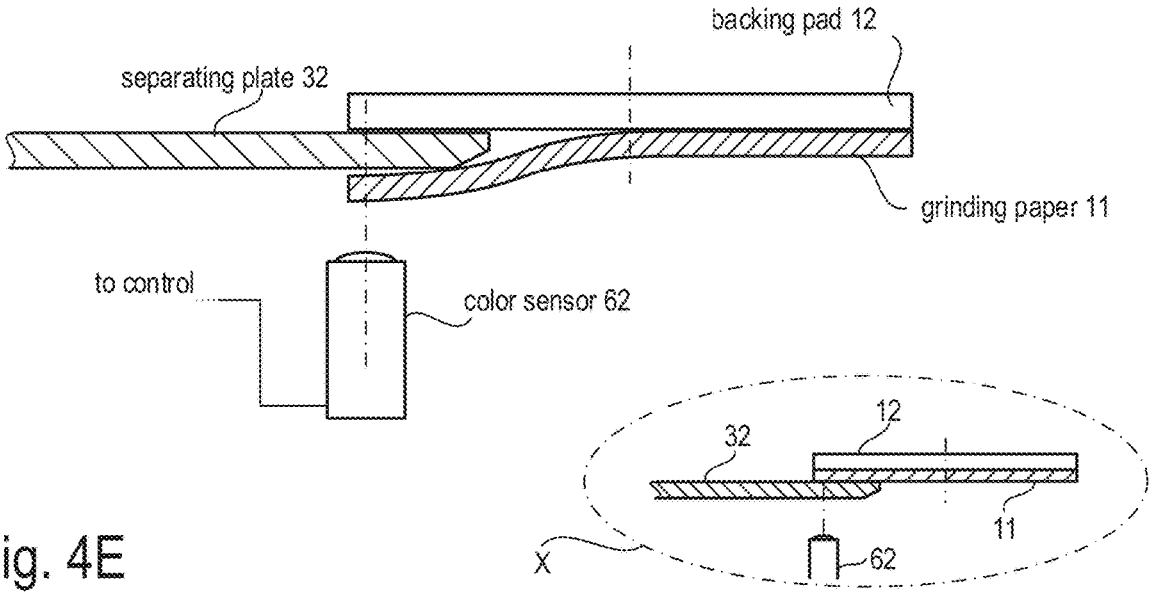

FIG. 4E shows a simplified cross section view of a situation similar to the one of FIG. 4B, wherein the separating plate 32 has just been inserted to a small extent into the space between backing pad 12 and grinding disc 11. Further, a color sensor 62 is shown that is arranged directed at the underside of the separating plate 32. Thus the sensor 62 "sees" either the underside of the separating plate 32 or the grinding disc 11 inserted between the sensor 62 and the separating plate 32. The color sensor 62 can be configured to recognize a certain specifiable color (color detection). For example, the color sensor 62 may be calibrated to the color of the separating plate 32 (the target color is the color of the separating plate 32). A binary sensor signal, for example, indicates whether an object is present in front of the sensor (i.e. in the range of detection/field of view of the sensor) of the target color.

When the separating plate 32 is inserted, as desired during the removal process, between the backing pad 12 and the grinding disc 11, the color sensor 62 first "sees" the (e.g. metallic) color of the separating plate 32 and then (after the separating plate 32 has been inserted far enough) the color of the grinding disc (and no longer the color of the separating plate 32). The color sensor 62 then signalizes to the controller (e.g. the robot controller or an upstream control unit) that the separating plate 32 is no longer visible, indicating that the removal process has been correctly initiated. If the color of the separating plate 32 remains visible, this indicates that the separating plate 32 has not been properly inserted between the backing pad 12 and the grinding disc 11, as is shown in the detail X. The robot can detect this (undesirable) situation by means of the color sensor 62 and, for example, initiate a second attempt to remove the grinding disc 11 from the backing pad 12. Alternatively (or after the second attempt has failed), the robot controller can automatically move the manipulator, together with the grinding machine, into a maintenance position. Instead of the color sensor 62, other sensors that are based on color detection may be employed as well. For example, in place of a color sensor, a proximity sensor/proximity switch may also be employed. Optical proximity sensors, ultrasonic proximity sensors, as well as inductive or capacitive proximity sensors or proximity switches, for example, may all be considered for this purpose.

Figure 5A:
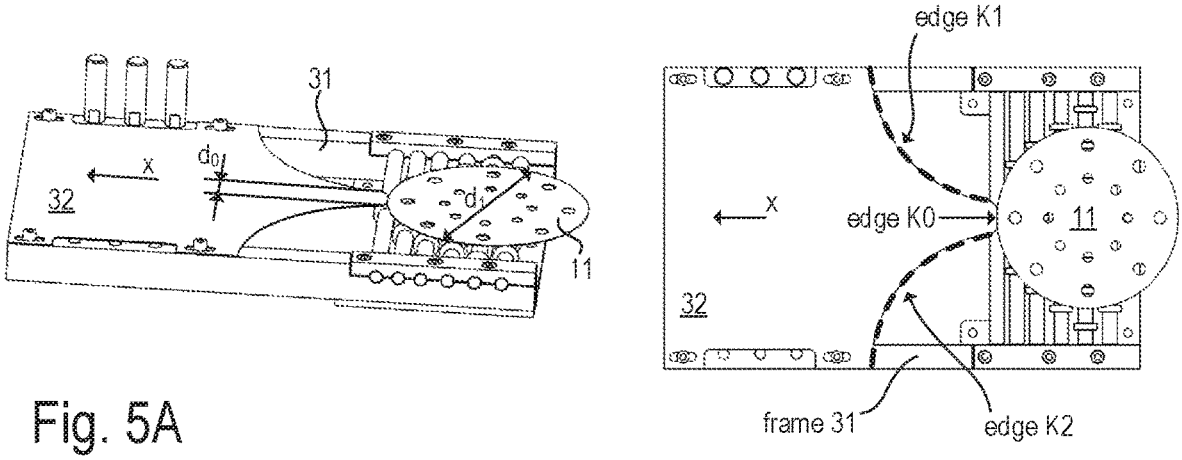
Figure 5B:
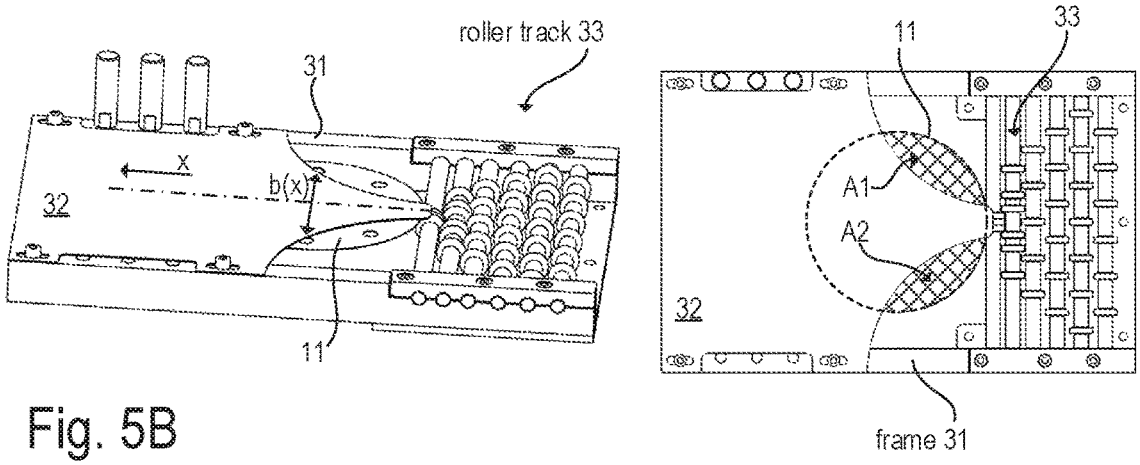
Figure 5C:
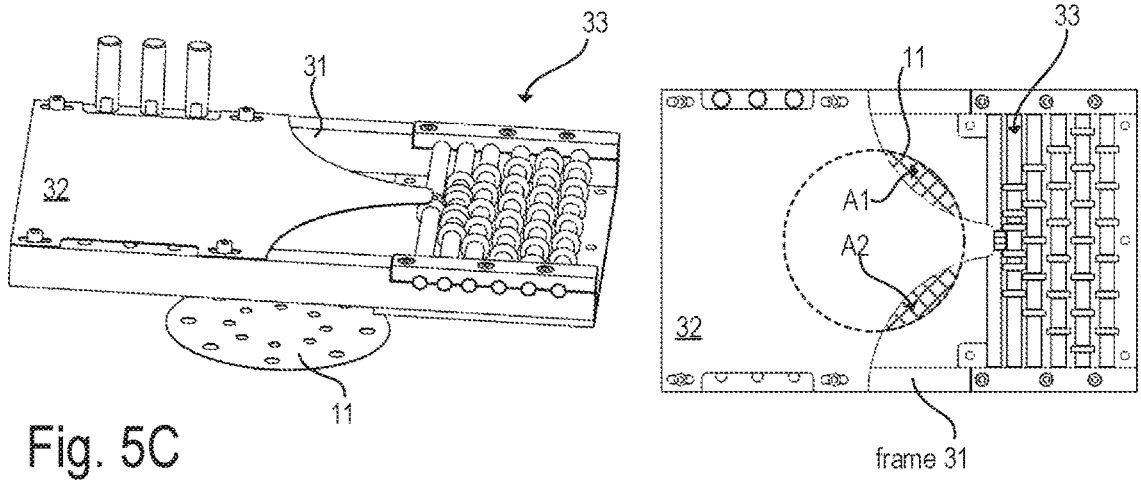

FIGS. 5A-C show the same example of FIGS. 4A-E, here illustrating the process of removing the grinding disc 11 from the backing pad 12 of the grinding machine 10 more precisely. The illustrations on the left in FIGS. 5A-C are isometric representations; those on the right are their corresponding top views. For greater clarity, only the apparatus for removing the grinding disc 11 and the grinding disc 11 are shown in FIGS. 5A-C and the grinding machine 10 and the actuator 20 have been omitted. The FIGS. 5A, 5B and 5C show the process of removing the grinding disc 11 at three consecutive points in time. The expanse of the edge of the separating plate 32 that faces the grinding disc is formed by the three edges K0, K1 and K2 (see FIG. 5A), wherein the edge K0 lies essentially parallel to the axes 35 of the roller track 33 (and thus perpendicular to the direction x in which the grinding disc advances). The length do of the edge K0 (see FIG. 5A, illustration at left) is much smaller than the diameter $d_1$ of the grinding disc 11 (e.g. $2 \cdot d_0 < d_1$). In the x direction, the width b(x) of the separating plate 32 becomes constantly greater (wherein $b(0)=d_0$) until it obtains a maximum width that depends on the width of the frame 31. The width b(x) defines the distance between the side edges K1 and K2 of the separating plate 32, both of which are designated with a dashed line in FIG. 5A (illustration at right). The edges K0, K1 and K2 can be straight (in this case the right side of the separating plate would be trapeze-shaped). In the example shown only the front edge K0 is straight (with slightly rounded corners) and the edges K1 and K2 are arch-shaped.

The situation in FIG. 5A essentially corresponds to the situation in FIG. 4B. Again, the separating plate 32 (specifically, the foremost edge K0 of the separating plate) is just about to be inserted into the space between grinding disc 11 and backing pad 12 as the grinding machine 10 is moved over the roller track 33 towards the separating plate 32. At first the grinding disc 11 is only detached across a very narrow area (width $b(0)=d_0$), which becomes progressively wider as the separating plate 32 is inserted deeper and deeper into the space between the grinding disc 11 and the backing pad 12. The edges K1 and K2 can be formed such that a specific surface area of the grinding disc is detached per unit of time, provided the speed with which the grinding disc 11 advances in the x direction remains constant, making it possible to keep the stress on the hook and loop fastener to a constant minimum. The separating plate 32 (and its edges K0, K1 and K2) is formed to ensure that—when the edge K0 completely extends through the space between grinding disc 11 and backing pad 12—the grinding disc 11 still stays adhered to the backing pad 12 across the relatively small surface areas A1 and A2 at the rim of grinding disc 11. This situation is depicted in FIG. 5B. In FIG. 5C the grinding disc 11 has moved even further, as compared to FIG. 5B, in the x direction and the surface areas A1, A2 across which the grinding disc 11 is still adhered have already become relatively small. In this situation the grinding disc has already completely left the roller track 33. When the grinding disc 11 is moved—from the position shown in FIG. 5C—even further in the x direction, the sum of the surface areas A1+A2 approaches zero and the grinding disc is completely detached, after which it can fall out from beneath the apparatus. The path downward is no longer obstructed by the roller track 33 because the grinding disc 11 is not completely detached from the backing pad 12 until the grinding disc 11 has completely left the roller track 33. In this manner the grinding disc 11 is prevented from becoming jammed or "stuck" between the roller track and the separating plate 32. Alternatively, in the situation depicted in FIG. 5C the grinding machine can also be raised. Also in this manner the grinding disc 11 will be completely detached from the backing pad 12 (cf. also FIG. 4D).

In the example of FIGS. 4A-E and 5A-C the support surface for the grinding discs 11 that are to be removed is formed by the roller track 33. As an alternative to a roller track 33, a carriage that slides along a linear guide can also be employed. An example of this variation is illustrated in FIGS. 6A-E. The illustrations in FIGS. 6A to 6E show the apparatus of FIG. 3 (grinding machine 10 together with actuator 20) and an apparatus for detaching the grinding disc 11 from the grinding machine 10 in various situations during the removal of the grinding disc 11. In accordance with the example illustrated in FIGS. 6A-E, the apparatus for detaching a grinding disc from a grinding machine with a rotating grinding disc comprises—similar to the previous example of FIGS. 4A-E—a frame 31, a separating plate 32 that is connected to the frame 31, as well as a support surface, also connected to the frame 31 and formed, in this case, by a carriage 33*b* that is slidably mounted on a linear guide. The linear guide is formed, e.g. by a track 33*a* mounted on the frame 31 and along which the carriage 33*b* can slide in one direction (see FIGS. 6A and 6B, x direction).

The frame 31 and the carriage 33*b* are wide enough to enable a grinding machine 10 that is connected to a manipulator 1 (see FIG. 1) to be pressed against the support surface (defined by the carriage 33*b*) such that the grinding disc 11 mounted on the grinding machine rests against the support surface. In this position, the flat grinding disc 11 lies nearly parallel to the direction of movement (x direction) of the carriage 33*b*. Pressing the grinding machine against the carriage 33*b* is carried out, e.g. by the actuator 20, which also allows to control the contact force between the carriage 33*b* and the grinding disc 11. As mentioned earlier, (as opposed to during grinding) here it is not absolutely necessary to precisely control the pressing force between grinding disc 11 and carriage 33*b*. The pressing force between the grinding disc 11 and the carriage 33*b* should, however, be strong enough to prevent the resulting static friction from causing a relative movement between the grinding disc 11 and the carriage 33*b*.

The carriage 33*b* that is mounted on the track 33*a* enables the grinding machine 10, and with it the grinding disc 11, to be slid in the x direction (towards the separating plate 32) without a relative movement between the carriage 33*b* and the grinding disc 11 taking place. Material abrasion of the carriage is thereby largely prevented. The sliding movement of the grinding disc 11 (and of the carriage 33*b*) along the track 33*a* is carried out by the manipulator 1. Neither the carriage 33*b* nor the separating plate 32 require a separate drive.

Figure 6A:
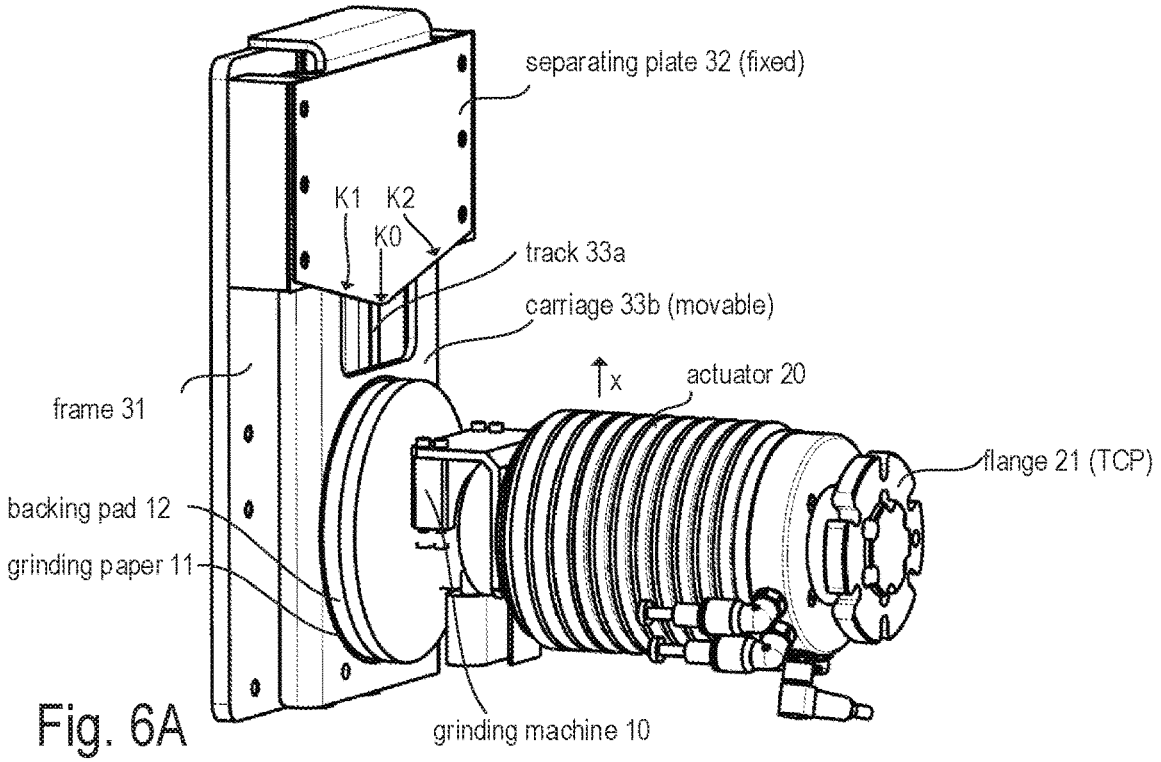
Figure 6B:
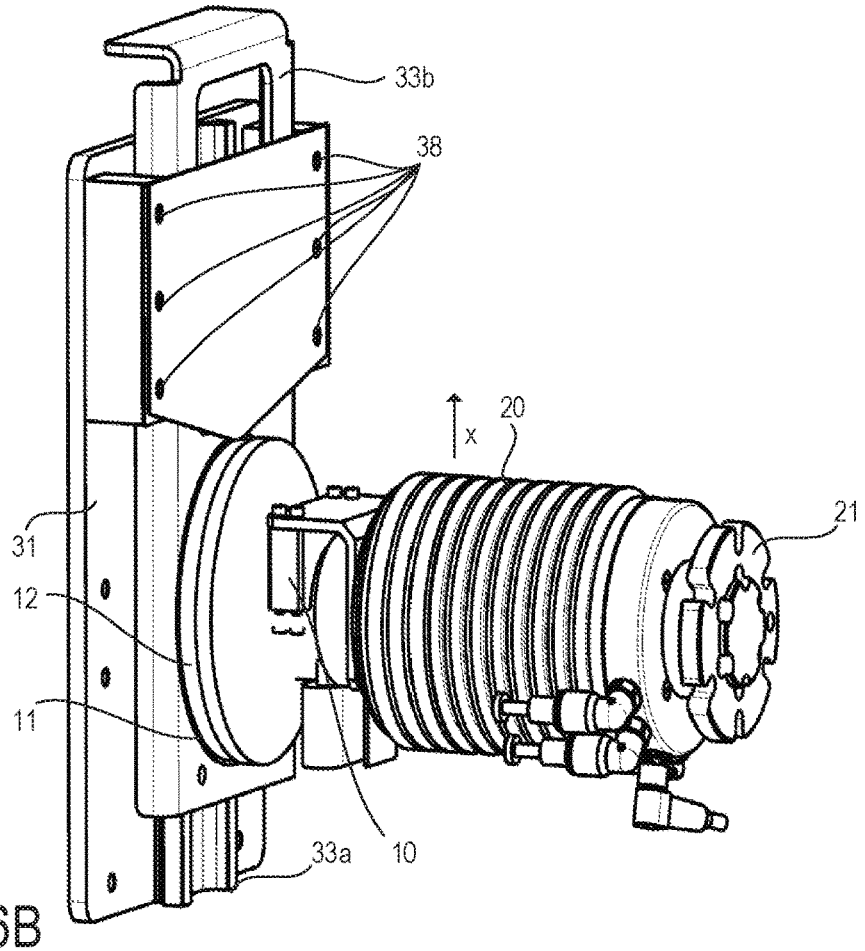
Figure 6C:
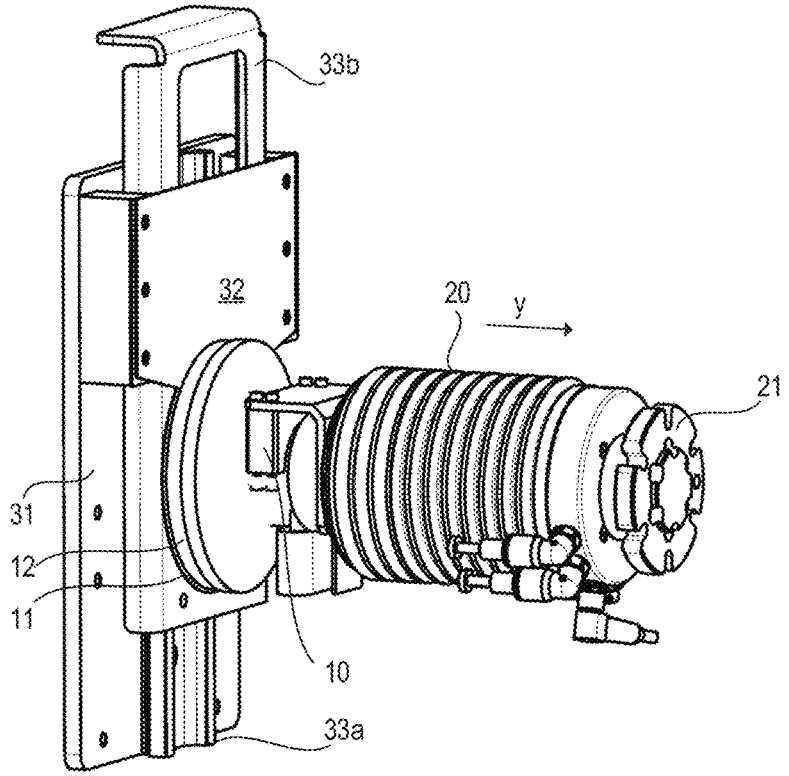

FIG. 6B shows the beginning of the grinding disc removal process. As mentioned above, the manipulator 1 moves the grinding machine, pressed against the carriage 33*b*, towards the separating plate 32. The separating plate 32 is arranged relative to the carriage 33*b* such that—when the grinding machine 10 with the grinding disc 11 is pressed against the support surface (on carriage 33*b*)—an edge of the separating plate 32 is inserted between the grinding disc 11 and the backing pad 12 which releases the fastening between the two parts (grinding disc 11 and backing pad 12) and clamps the grinding disc 11 in place between the separating plate 32 and the carriage 33*b*. This situation is depicted in FIG. 6C. If a hook and loop fastener is used between the grinding disc 11 and the backing pad 12, it will be gradually opened by the separating plate 32 while the separating plate 32 is being inserted between the grinding disc 11 and the backing pad 12 (see FIG. 6C).

Figure 6D:
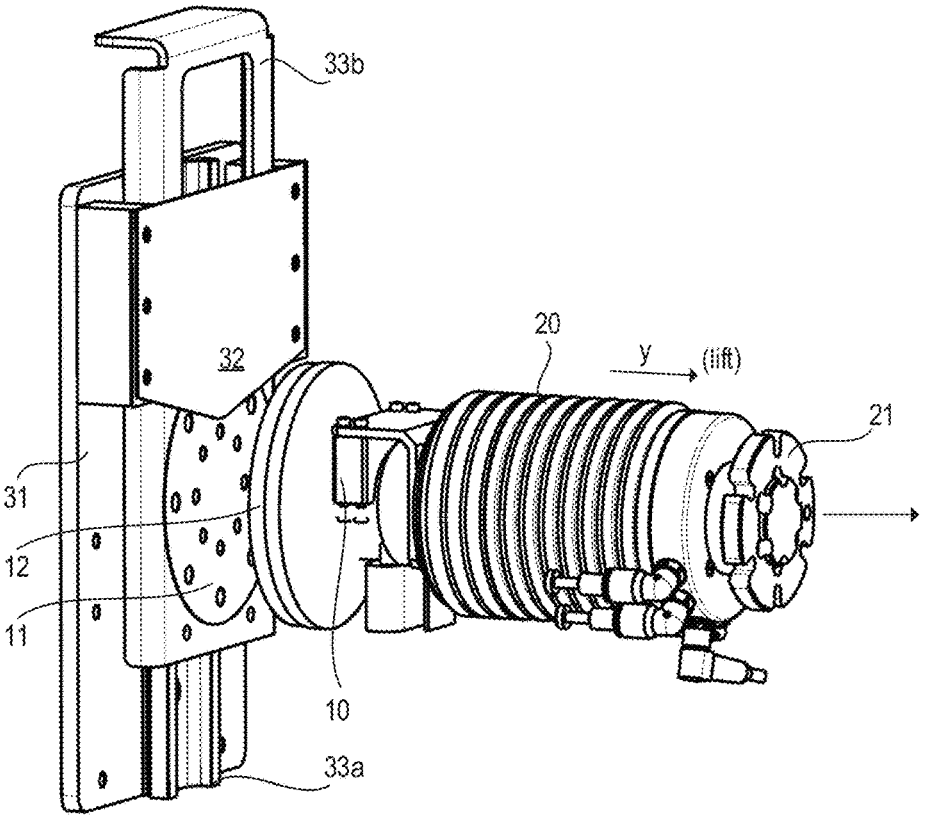

As soon as the grinding disc 11 is clamped in place between the separating plate 32 and the carriage 33*b*, the grinding machine 10 (including the backing pad 12) can be lifted off the carriage (in the direction y, perpendicular to the support surface), thereby completely detaching the clamped grinding disc from the backing pad 12. This situation is depicted in FIG. 6D. The process of removing the grinding disc has now been completed and the grinding machine 10 is ready to receive a new grinding disc 11. The movement of lifting the grinding machine 10 in the y direction can be effected (as in the example of FIGS. 4A-E) either by the actuator 20 or by the manipulator 1 (or both).

Figure 6E:
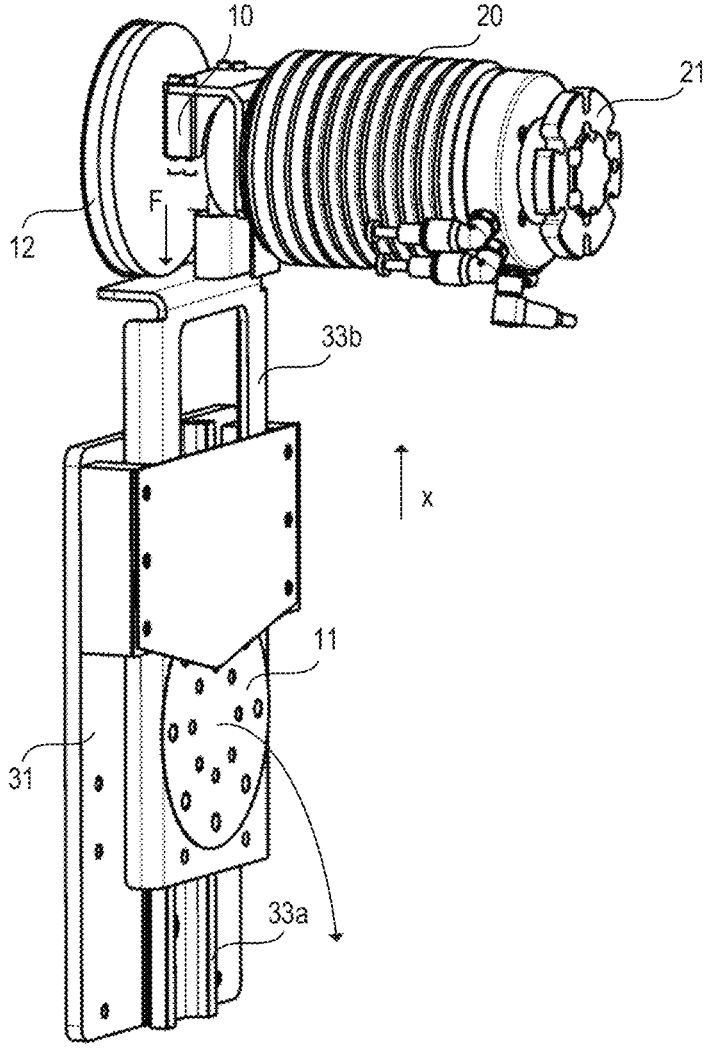

In order to once again release the grinding disc 11 clamped between separating plate 32 and carriage 33*b*, the carriage 33*b* must be moved back (away from the separating plate 32) into its original position. This may be carried out automatically, e.g. by coupling the carriage 33*b* with the frame 31 using a spring that is tensioned when the carriage is moved in the x direction and that forces the carriage 33*b* back into its original position after the grinding machine 10 is lifted off the support surface. Alternatively, the manipulator 1 can be programmed to push with the grinding machine 10 or an arm segment against the carriage 33*b*, thus exerting a force F (see FIG. 6E) on the carriage 33*b* counter to the x direction. A brief nudge will then suffice to move the carriage 33*b* back into its original position (shown in FIG. 6A) and to unclamp the grinding disc 11. The grinding disc will then fall from the apparatus under the force of gravity. This situation is depicted in FIG. 6E.

As mentioned earlier, the apparatuses for removing grinding discs in accordance with the FIGS. 4A-4E, 5A-4C and 6A-4E do not need their own drives. The needed relative movement between grinding machine 10 and separating plate 32 is essentially provided by the manipulator that carries the grinding machine 10. The contact force between support surface and grinding machine 10 is primarily effected by the actuator 20. The variation illustrated in FIGS. 7A-D functions essentially the same as the embodiment of FIGS. 6A-E, although in this case the grinding machine 10 with the grinding disc 11 is pressed against a stationary support surface while the separating plate 32 moves towards the grinding disc 11. For this purpose, the separating plate 32 is mounted by means of a linear guide to be slidably moveable relative to a carrier frame 31, wherein the sliding movement is effected by a separate linear drive 34 that is mechanically coupled between the (slidably mounted) separating plate 32 and the carrier frame 31. The mounting of the separating plate 32 on the carrier frame 31 is realized by means of tracks 31*a* arranged to the left and right of the separating plate 32.

Figure 7A:
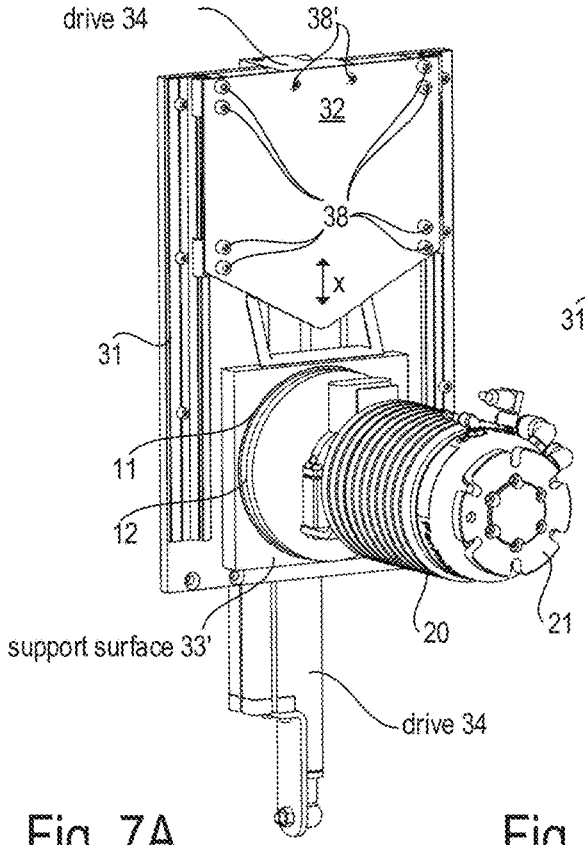
Figure 7B:
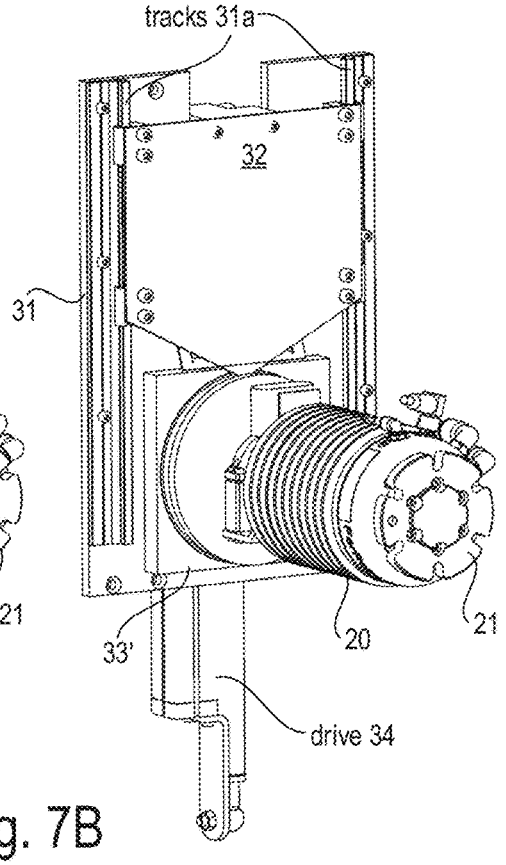
Figure 7C:
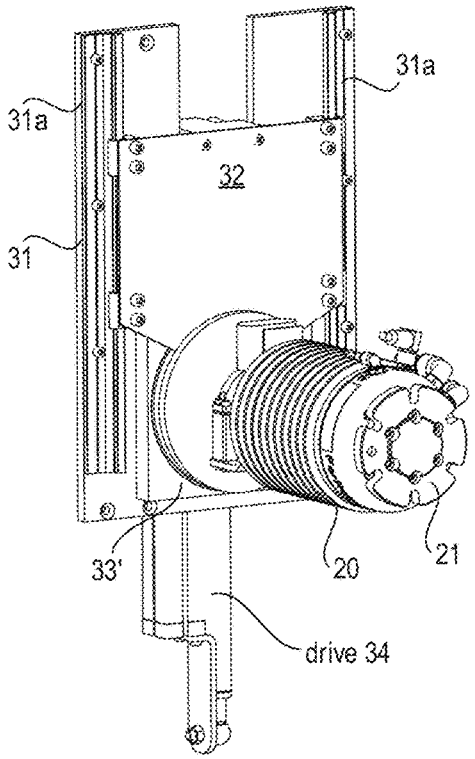
Figure 7D:
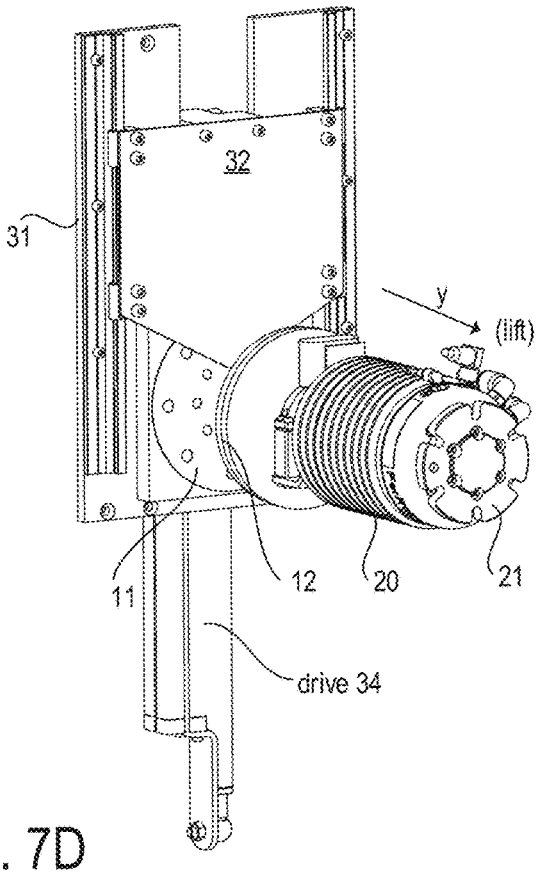

FIG. 7A shows the apparatus after the grinding machine 10 with its grinding disc has been placed on the support surface 33'. The separating plate 32 is in a starting position, distant from the grinding machine. The drive 34 of the separating plate 32 is activated and the separating plate 32 moves towards the grinding disc 11. FIG. 7B shows a situation in which the separating plate 32 is just in the processing of being inserted into the space between grinding disc 11 and backing pad 12 of the grinding machine and of clamping the grinding disc 11 between the separating plate 32 and the support surface 33' while detaching the grinding disc 11 from the backing pad 12. FIG. 7C depicts a situation in which the separating plate 32 clamps the grinding disc 11 against the support surface 33'. In this situation the grinding machine 10 (including the backing pad 12) can be lifted off the support surface 33' (in they direction, perpendicular to the support surface), thereby completely removing the clamped grinding disc 11 from the backing pad 12. This situation is depicted in FIG. 7D. The process of removing the grinding disc has now been completed and the grinding machine 10 is ready to receive a new grinding disc 11. The lifting movement of the grinding machine 10 in the y direction may be effected (as in the example of FIGS. 4A-E) either by the actuator 20 or the manipulator 1 (or both). The separating plate 32 can be moved back into its original position with the aid of the linear drive.

Figure 8A:
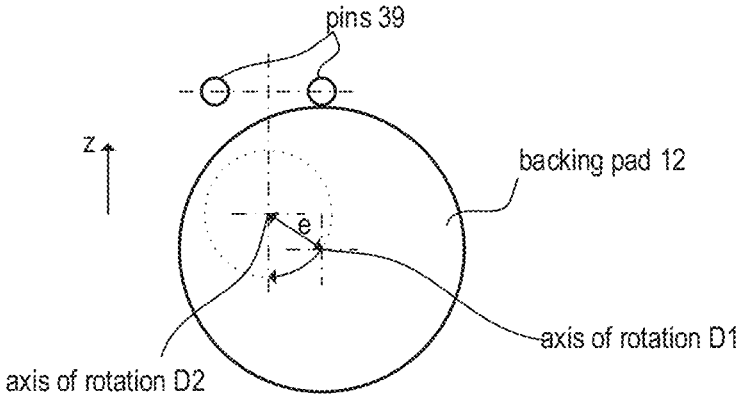
Figure 8B:
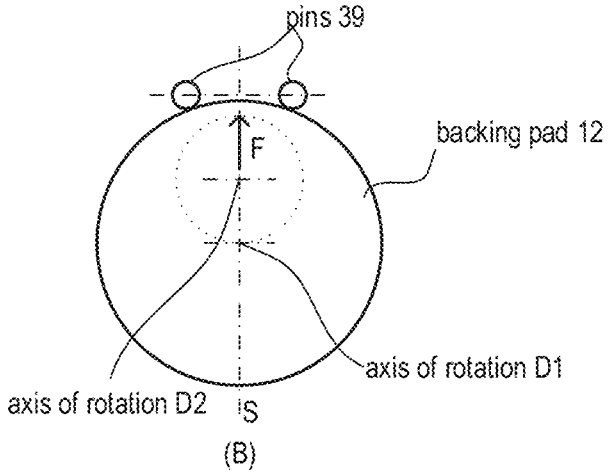

In an orbital grinding machine the grinding disc 11 does not rotate around a central axis of rotation, but rather carries out a more complex movement that can be described by two axes of rotation, D1, D2 (see FIG. 8A). In the examples described here, the axis of rotation D2 is the long axis A (see FIGS. 1 and 2), on which the TCP lies (which need not necessarily be the case) and the axis of rotation D1 is the eccentric axis of rotation A' shown in FIG. 2*a*. Here the grinding disc 11 rotates around an axis of rotation D1 that moves along a path around a second axis of rotation D2. The distance between the axes of rotation D1 and D2 is designated as eccentricity. When the rotational movement of the grinding disc 11 stops, the angulation of the axis of rotation D1 on its path around the axis of rotation D2 is virtually coincidental. In particular when the grinding disc 11 and the backing pad 12—as shown in FIG. 2*c*—have holes (for the extraction of the grinding dust, the holes, however, are not shown in FIGS. 8A-B), it can be important that the axes of rotation D1 and D2 of the backing pad 12 be in a defined position relative to each other and that the angle position of the grinding disc relative to the axis of rotation D1 be clearly defined before a new grinding disc is attached. If a round backing pad 12 is used, as shown in FIGS. 8A-B, the backing pad of a grinding machine can be pressed by the manipulator 1 (in the z direction) against a stop with two, e.g. cylinder-shaped pins 39 that are arranged at a given distance to each other and that, e.g. can be attached to the carrier frame 31 (see also FIG. 4A). By means of this pressing, the axes of rotation D1 and D2 are aligned along a symmetry axis S between the pins 39 and brought into a defined reference position. This situation is depicted in FIG. 8B. If the grinding machine 10 has a motor in which the angulation of the motor shaft is adjustable (e.g. a synchronous motor with a rotary encoder), the desired reference position can also be set by appropriately controlling the (electric) motor of the grinding machine. In place of the pins, non-cylindrical objects may also be used. The stop comprises essentially two pins (or abstract edges that run parallel to the axis of rotation D1) and the perimeter of the backing pad 12 is pressed against the edges.

Figure 9:
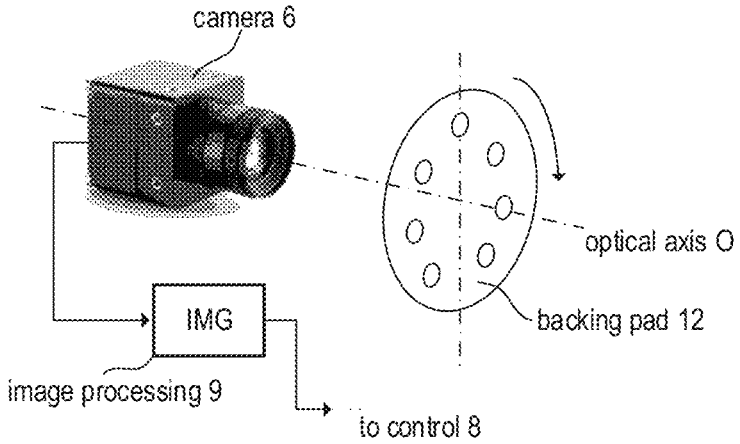
FIG. 9 shows an example of a camera-based alignment of the angulation of the grinding disc.

Additionally or alternatively to the mechanical alignment of the axes of rotation, in accordance with FIGS. 8A-B a camera-based alignment may also be provided, as is outlined in FIG. 9. Even when the axes of rotation D1 and D2, as depicted in FIG. 8B, have been aligned along a defined line, the angulation of the backing pad 12 relative to the axis of rotation D1 is not necessarily known. This can be determined, e.g. using a camera. A camera-based alignment of the grinding machine 10 (and thus also of the backing pad 12) may be considered in the case of more complex grinding disc geometries (i.e. triangular). For this, the grinding machine 10 is arranged such that the backing pad 12 (in other words, the plane on which the grinding disc is arranged) lies perpendicular to the optical axis O of the camera 6. The position of the optical axis being a priori known, the manipulator 1 can easily position the grinding machine correspondingly. If the backing pad 12 has a perforated pattern, this can be detected using simple image processing algorithms. The image processing algorithm can determine the angular position of the backing pad, e.g. based on a geometry of the perforated pattern that can be detected in a camera image, or based on the color (and/or brightness) of the holes (a hole H will have a different color in the camera image than the rest of the backing pad 12). Based on the detected perforation pattern, the correction angle φ by which the manipulator 1 must rotate the grinding machine 10 (axis of rotation is the optical axis O) in order to achieve a defined desired angular position of the backing pad can be easily calculated. The image processing unit 9 can be integrated in the robot controller (see FIG. 1) or be implemented as a separate hardware unit. For example, the image processing unit 9 passes the calculated correction angle φ on to the robot controller 8. Once the backing pad 12 of the grinding machine has assumed a defined angulation, a new grinding disc can be attached to the backing pad. An apparatus suitable for this purpose is illustrated in FIGS. 11 and 12.

Figure 10:
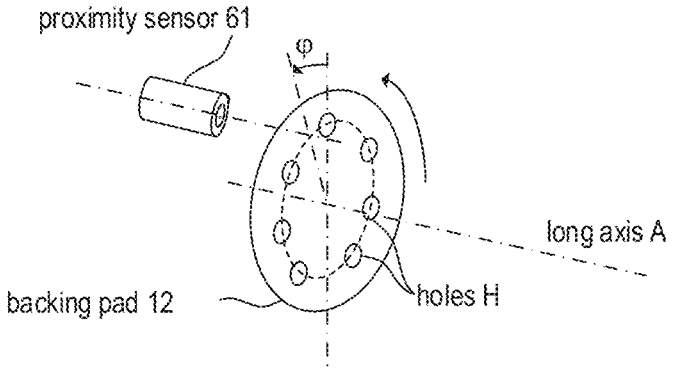
FIG. 10 shows an example of the alignment of the grinding disc by means of distance sensors.

FIG. 10 shows the alignment of the grinding machine 10 (including backing pad 12) using a proximity sensor 61. As in FIG. 9, for the sake of simplicity only the backing pad 12 is shown, although the latter is mounted on the grinding machine 10. With the aid of the manipulator (cf. FIG. 1), the grinding machine 10, together with the backing pad 12, can be positioned relative to a proximity sensor 61 such that the proximity switch is aimed precisely at that point on the backing pad 12 at which a hole H should be present. If there is indeed a hole present at the desired position, this target condition (the desired angulation of the backing pad 12) will be detected by the proximity sensor. If there is no hole at the desired position, the backing pad 12 can be rotated until the proximity sensor 61 detects a hole H. The backing pad 12 can be rotated, for example, by the manipulator rotating the entire grinding machine 10, together with the backing pad 12, around the axis A (e.g. as depicted in FIG. 10, by an angle φ).

The proximity sensor 61 can be, for example, an optical sensor that is capable of determining the distance to the backing pad 12. When the proximity sensor 61 "sees" a hole H, the measured distance is larger than in a situation in which there is no hole in the range of detection of the sensor. The proximity sensor 61 can have a digital output that emits a logic signal. This logic signal indicates whether or not a hole has been detected. A proximity sensor of this kind is also known as a proximity switch. In one example, the proximity switch 61 is insensitive to the distance to the backing pad 12, but is sensitive to color. This means that the sensor 61 is sensitive to a (specific, adjustable) color. As soon as a hole H enters the range of detection (field of view) of the sensor 61, the sensor "sees" a different color and can signal that the hole H has been detected (e.g. by means of a logic signal). The proximity sensor 61 may also be based on detection principles other than optical. Ultrasonic proximity sensors, for example, can be employed. If the backing pad contains iron or other metals, inductive or capacitive proximity sensors may also be used.

Figure 11:
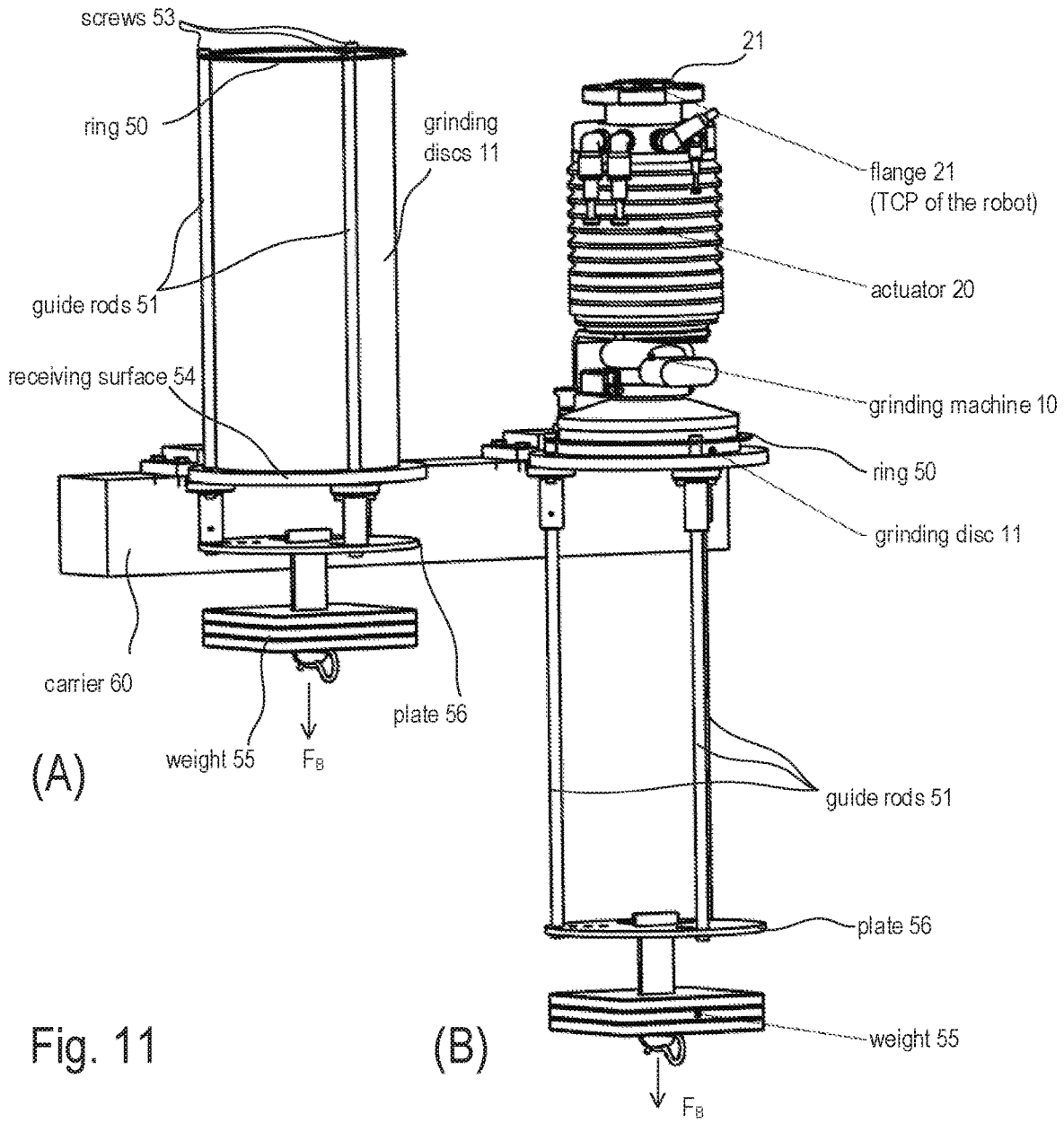
FIG. 11 shows an example of an apparatus for automatically attaching an (non-worn) grinding disc to the grinding tool of FIG. 3, as well as the employment of the apparatus, which also does not require its own drive.
Figure 12:
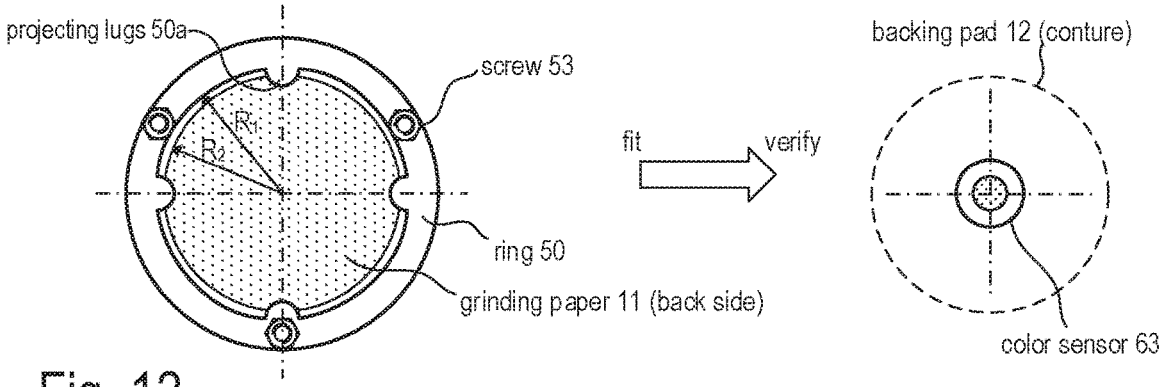
FIG. 12 shows a top view of a grinding paper hopper as used in the apparatus in accordance with FIGS. 8A-B.

In FIG. 11 two apparatuses 5 and 5' for automatically fitting a grinding disc 11 onto a grinding machine 10 are shown next to each other, wherein the grinding machine 10

(together with the actuator 20, see FIGS. 1 and 3) is moved with the aid of a manipulator 1. The apparatuses 5 and 5' are practically identical, excepting that the apparatus 5 (on the left) has a hopper full of grinding discs 11, whereas the apparatus 5' (on the right) has a hopper nearly empty of grinding discs 11. The apparatuses 5 and 5' comprise a receiving surface 54 on which a stack of grinding discs 11 can be arranged. The receiving surface 54 is, e.g. mounted on and may be rigidly connected to a carrier 60. For the lateral stabilization of the stack, numerous guide rods 51 are arranged laterally around the stack (around the periphery of the grinding discs 11). The guide rods 51 extend essentially perpendicular to the receiving surface 54 (on which the grinding discs rest) and are connected to each other (e.g. using screws 53) over a ring 50 on the topside of the stack.

The guide rods 51 are, e.g. essentially cylindrical and are mounted on the receiving surface 54 to be moveable along their long axis. Regardless of the height of the stack of grinding discs, the ring 50 lies (at least partially) rests on the topmost grinding disc of the stack and the guide rods 51 extend—regardless of the height of the stack of grinding discs—under the receiving surface 54 away from the surface. The guide rods 51 are connected at their lower ends over a plate 56 that stabilizes the position of the guide rods 51 relative to each other. A weight 55 can also be attached to the plate 56 in order to pretension the guide rods 51 with a defined force $F_B$ (i.e. the weight force of the weight 55). The force $F_B$, however, could also be effected by a spring or by a linear actuator operating between the plate 56 and the receiving surface 54. The force is transferred via the guide rods 51 to the upper ring 50 which, as a result, presses against the stack of grinding discs with essentially the same force FB, holding the grinding discs 11 in place. Depending on the specific design of the apparatus 5 or 5', the weight 56 can also be omitted if the dead weight of the guide rods 51 and the plate 56 is sufficient.

FIG. 12 shows a grinding disc hopper 5 from above, revealing the ring 50 and the stack of grinding discs in a top view. The grinding discs 11 have an outer diameter of 2·R2 and the ring 50 has a somewhat larger inner diameter 2·R1 ($R_1$>$R_2$). The ring 50 if further provided with one or more (in the present case four) projecting lugs 50*a* whose distance to the center point of the grinding discs is somewhat smaller than $R_2$, so that the lugs slightly overlap the outer rim of the grinding discs 11, pressing the grinding discs (with the force FB) against the receiving surface 54 and holding the grinding discs 11 in place. In FIG. 12 the screws with which the guide rods 51 can be attached to the ring 50 are also shown. The grinding discs 11 are arranged in the stack with their backsides facing upwards. As mentioned earlier, their backsides are provided with an adhesive layer (e.g. one side of a hook and loop fastener).

On the right side of FIG. 11 the almost empty grinding disc hopper of 5' is depicted in a situation in which a new grinding disc 11 is just being "picked up" by the robot-supported grinding apparatus (manipulator 1, actuator 20 and grinding machine 10). When doing so, the manipulator positions the grinding machine 10 over the apparatus 5 or 5' so that the (empty) backing pad 12 of the grinding machine 10 is nearly parallel to the ring 50. Approaching from above, the manipulator 1 can then move towards the apparatus 5 or 5' until the grinding machine 10 contacts the ring 50, thereby also contacting the topmost grinding disc 11. This contact can be determined, e.g. by the actuator 20, beginning at its end stop (maximum deflection of the actuator) moving towards smaller deflections. For this the actuator 20 may have e.g. a position sensor that is configured to measure the deflection of the actuator 20. The measured values can be passed on, e.g. to the robot controller (see FIG. 1). As soon as contact between the backing pad and the ring 50 has occurred, the manipulator 1 can stop and the actuator 20 can press against the ring 50 and the backside of the topmost grinding disc of the hopper with a defined force, causing the grinding disc 11 to attach to the backing pad. After this the manipulator can once again raise the grinding machine 10. When the adhesion between the grinding disc 11 and the backing pad 12 of the grinding machine 10 is greater than the holding force FB with which the ring 50 holds the grinding disc in place, the grinding disc 11 can be lifted off the stack together with the grinding machine 10 and the subsequent grinding can be started using a new grinding disc 11. As soon as the grinding disc becomes worn a new changing procedure can be initiated and the worn grinding disc can be removed, e.g. with the apparatus in accordance with FIGS. 4A-E.

If the grinding discs have a geometry that is not circular then, instead of ring 50, a frame having a different geometry, adapted to the geometry of the grinding discs, may be used. In accordance with a general embodiment, a frame (e.g. the ring 50) is pressed from above against a stack of grinding discs 11 with a defined force $F_B$ to keep the stack in place. The inner contour of the frame (see FIG. 12, radius $R_1$) is slightly greater than the outer contour of the grinding discs 11 (see FIG. 12, radius $R_2$), whereas the inner contour of the frame has projecting lugs (see FIG. 12, lugs 50*a*) that overlap the outer contour of the grinding discs 11. The lugs 50*a* overlap only a comparatively small surface area of the grinding discs (as compared to the total surface area of the grinding disc 11) and the grinding disc 11 can be easily lifted from the stack while remaining attached to the backing pad 12.

After fitting a new grinding disc onto the grinding machine 10, a further color sensor 63 (or, alternatively, the camera 6, cf. FIG. 9) can be used to automatically verify (e.g. after fitting the grinding disc onto the grinding machine or before beginning the grinding) whether the grinding disc has been correctly fitted on the grinding machine. This procedure is depicted on the right side of FIG. 12. Generally, the backing pad 12 has a different color than that of unused grinding discs. Consequently, the color sensor 63 (or a camera functioning as a color sensor) can be used to distinguish a backing pad 12 on which a grinding disc 11 has been fitted from a backing pad 12 without a grinding disc based on the detected color. For this purpose, the manipulator moves the grinding machine 10 into a position near the color sensor 63 that allows the sensor to "see" either the front side of the grinding disc 11, or (in the absence of a grinding disc 11) the backing pad. The color sensor 63 (color detector) can be adjusted to recognize the color of the backing pad 12. As soon as the backing pad 12, based on its color, is detected, the robot controller 8 can emit an error signal ("Error: Machine has no grinding disc"). The robot controller can then initiate a new fitting procedure in order to fit a grinding disc 11 onto the grinding machine 10. Thus, if for any reason at all a fitting procedure (see further below, FIGS. 11 and 12) fails, the robot can be prevented from starting a new grinding procedure without a grinding disc, which could result in the backing pad 12 (or the workpiece) being destroyed. Alternatively, the color sensor 63 can also be calibrated to the color of the (new) grinding discs.

Figure 13:
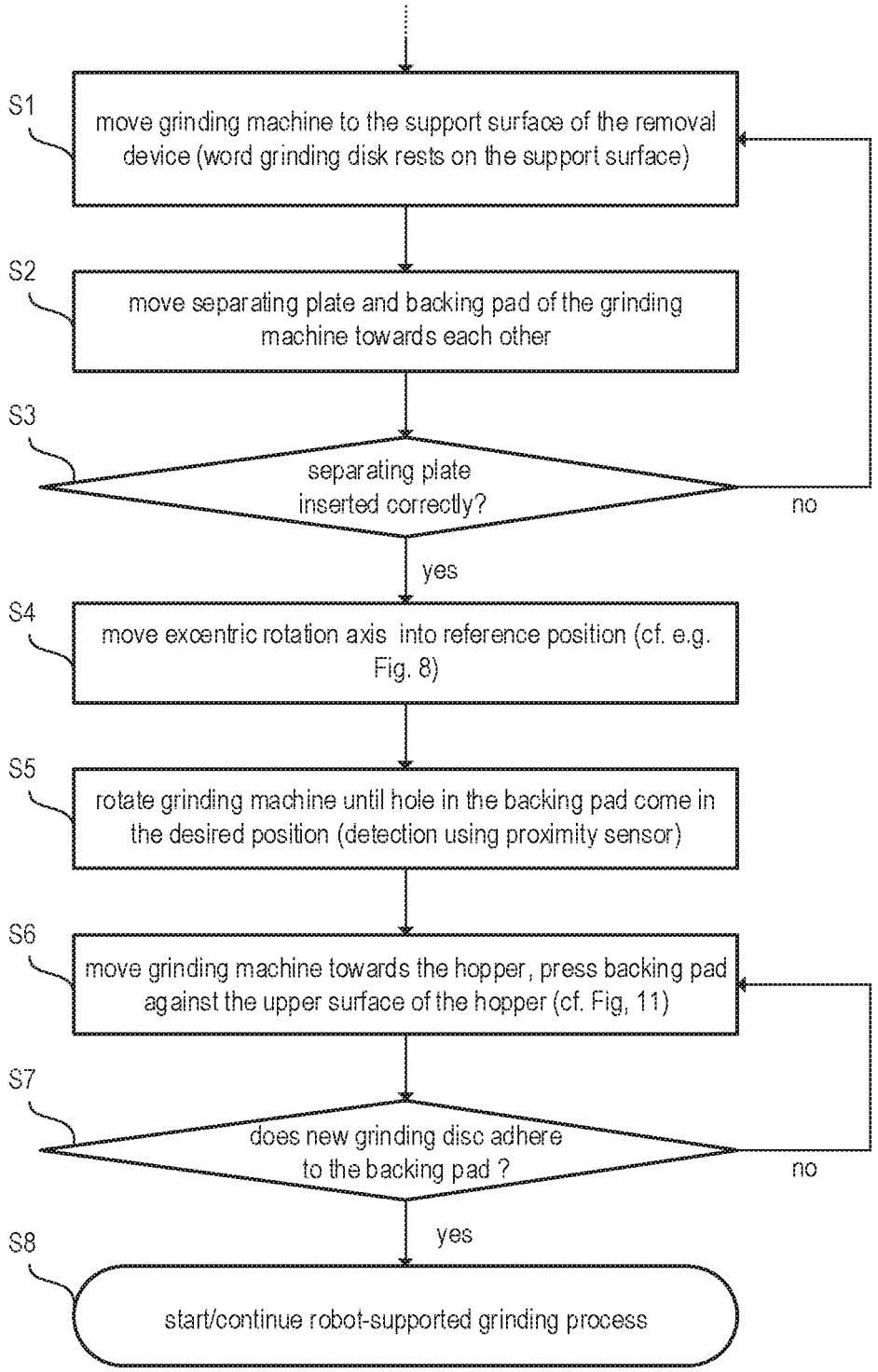
FIG. 13 is a flow chart for illustrating an example of the methods described here for the automatic changing of grinding discs.

FIG. 13 illustrates using a flow chart an example of the method for automatically changing grinding discs that is described above with reference to FIGS. 4A-12. Not all of the illustrated steps are absolutely necessary in all embodiments of the method. When the grinding has been completed or a grinding disc has become worn, the manipulator 1 moves (step S1) the grinding machine towards the removal apparatus 2 and presses (with the aid of the actuator 20) the grinding disc against the support surface (e.g. see FIGS. 4A-E, roller track 33, FIGS. 6A-E, carriages 33*b* and FIGS. 7A-D, support surface 33'). After the grinding disc has been placed on the support surface, the separating plate 32 and the grinding machine 10 are moved towards each other (step S2) until the separating plate 32 is inserted between the backing pad 12 of the grinding machine 10 and the grinding disc 11 (see, e.g. FIGS. 5A, 6B, 7B). This movement can be effected by the manipulator 1 (cf. FIGS. 4A-E) or by a separate drive of the removal apparatus (cf. FIGS. 7A-D). A color sensor can be used to verify (step S3) whether the separating plate 32 has been correctly inserted between the backing pad 12 and the grinding disc 11 (see, e.g. FIG. 4E). Other sensors (e.g. proximity sensors) can be used for this purpose, as well. If verification produces a negative result, the process can be started again from the beginning (e.g. at step S1) or it can be interrupted. If verification produces a positive result, the grinding disc 11 will be detached from the backing pad as described above.

Orbital grinding machines and similar grinding machines have an eccentric axis of rotation. Further, the grinding discs may have holes H (see FIGS. 2, 9 and 10) for extracting grinding dust. These holes continue on into the backing pad 12, which is why the angular position of the backing pad 12 (relative to the grinding disc) should be properly defined when a new grinding disc is attached. To achieve this, first the eccentric axis of rotation (see, e.g. FIGS. 8A-B, eccentric axis of rotation D1) is moved into a reference position (step S4). This can be carried out by either pressing the backing pad 12 against an end stop (pins 39)—as shown in FIGS. 8A-B—or by correspondingly controlling the motor of the grinding machine, provided the latter is equipped with an angular encoder. Once the eccentric axis of rotation is in a defined reference position, the grinding machine 10 (in its entirety) can be rotated around the long axis (see, e.g. FIG. 2, long axis A, FIGS. 8A-B, axis of rotation D2) until the holes H come to rest in the desired angular position (target position, step S5). A proximity sensor (e.g. a proximity switch or color sensor) or a camera, for example, can be used to detect when the target position has been reached. This step is, naturally, optional when grinding discs without holes are used.

Once the eccentric axis of rotation is in the reference position and any given holes have reached their target position, the grinding machine 10 is moved towards the hopper containing the new grinding discs, and (step S6) the backing pad 12 is pressed against the topside of the hopper, e.g. with the aid of the manipulator 1 and the actuator 20 (see FIG. 11). As a consequence of the pressing force applied between the backing pad 12 and the grinding disc 11, the hook and loop fastener between the backing pad 12 and the grinding disc 11 engages and the grinding disc 11 stays fastened to the grinding machine 10. Given that the lugs 50*a* only overlap a relatively small surface area of the grinding disc, removing the grinding disc 11 from the hopper by lifting the grinding machine results in only minor deformation. Optionally, the manipulator 1 can move the grinding machine 10 into a test position in which sensors (e.g. color sensor, see FIG. 12) can be used to verify whether or not a new grinding disc has indeed been fitted on the grinding machine (step S7). If not, the manipulator can move the grinding machine back to the hopper (back to step S6) or it can interrupt the process. If the grinding disc has been properly mounted, the manipulator can start a new grinding process or continue a previously interrupted grinding process (step S8).

Various aspects of the embodiments described here will be summarized in the following. It should be noted that this is not an exhaustive listing. One embodiment relates to an apparatus for the automatic removal of a grinding disc from a robot-supported grinding apparatus with a grinding machine (cf. FIGS. 3, 4A-4E, 5A-5C, 6A-6E and 7A-7D). In accordance with this the apparatus (removal apparatus 2 for removing a grinding disc from the backing pad) comprises a frame 31, a separating plate 32 (designated in the figures as "separating sheet") connected to the frame 31, and a support surface connected to the frame 31. The separating plate 32 and the support surface are coupled with the frame 31 to allow for a relative movement between the separating plate 32 and the support surface in a first direction (in or against the direction x). The separating plate 32 and the support surface are arranged such that—when the grinding disc rests against the support surface and when the separating plate 32 and the grinding disc 11 are moved towards each other—a first edge K0 of the separating plate 32 is pushed over the grinding disc (cf. e.g. FIG. 5A, 6B or 7B).

The separating plate 32 can be rigidly connected to the frame 31 (cf. FIGS. 4A-4E, 5A-5C and 6A-6E). The support surface may be a roller track 33 (see FIGS. 4A-4E and 5A-5C). The roller track 33 may comprise numerous rollers 34 that are mounted on the frame 31. In this case the movement of the support surface (which may be said to be defined by the rollers) is brought about by the rotation of the rollers 34 of the roller track 33 around their respective axes, mounted on the frame 31.

In one embodiment the separating plate 32 and the roller track 33 are designed such that—when the separating plate 32 and the grinding disc 11 move towards each other—the separating plate 32 does not entirely cover the grinding disc 11 after the grinding disc 11 has left the roller track 33 (see FIGS. 5B and 5C). The aforementioned first edge K0 of the separating plate 32 is shorter than the maximum outer dimension (in the case of round grinding discs, diameter $d_1$) of the grinding disc 11 (cf. FIG. 5A). The width b(x) of the separating plate 32 in the direction transverse to x may vary (see FIG. 5B, arching contour of the separating plate 32 along the edges K1 and K2, or FIG. 6B, straight contour of the separating plate 32 along the moderately tapered edges).

In one embodiment the support surface is a carriage 33*b* that is mounted to be moveable in the direction x relative to the frame 31 (cf. FIG. 6A, track 33*a*, carriage 33*b*). In this case the moveable carriage 33*b* takes over the function of the aforementioned roller track 33. The separating plate 32 may here be rigidly connected to the frame 31.

In the embodiments according to FIGS. 4A-6E the apparatus does not require its own drive. The required movement is carried out by the manipulator 1 that guides the grinding machine (see also FIG. 1). Alternatively, the support surface can be rigidly connected to the frame 31 (cf. FIGS. 7A-D, support surface 33'). In this case the apparatus need a separate drive 34 between the separating plate 32 and the frame 31. The drive 34 is configured to move the separating plate 32 relative to the support surface 33'.

A further embodiment relates to an apparatus for automatically fitting a grinding disc 11 onto a grinding machine 10 of a robot-supported grinding apparatus (cf. FIG. 11). In accordance with this the apparatus comprises a receiving surface 54 for receiving a stack of grinding discs 11 and a frame (e.g. ring 50). The frame 50 is arranged essentially parallel to the receiving surface 54 with the stack of grinding discs 11 positioned between the receiving surface 54 and the frame 50, the frame 50 only partially overlapping the outer rim of the topmost grinding disc of the stack (e.g. with the projecting lugs 50*a*, see FIG. 12). The apparatus further comprises a mechanical pretensioning unit that is coupled to the frame 50 such that the frame exerts a defined force FB on the stack of grinding discs 11.

The mechanical pretensioning unit may comprise one or more guide rods 51 that are coupled to a frame 50 and extend laterally next to the stack of grinding discs and/or through the stack of grinding discs. For example, if the grinding discs have holes (see e.g. FIG. 2*c*), the guide rods 51 may be passed through these holes.

The pretensioning unit may have a weight 55 that is coupled to the frame 50 such that the weight force FB of the weight 55 is exerted on the frame 50. The guide rods 51 may extend through openings in the receiving surface 54. In this case the weight 55 may be connected to the guide rods 51 (and thus indirectly to the frame 50) underneath the receiving surface 54.

In one embodiment the stack of grinding discs has a nearly cylinder-like shape and the frame 50 has roughly the shape of a circle, the inner diameter of which is larger than the outer diameter of a grinding disc (see FIG. 12). The circle may also have one or more projecting lugs 50*a* that at least partially overlap the stack of grinding discs 11.

If the angular position of the grinding machine is of importance (e.g. if the grinding discs in the hopper are in some way perforated), the grinding machine 10 must be pressed against the grinding disc hopper in a correct angular position. In this case the apparatus may also comprise a camera 6 and an image processing unit 9 that is configured to determine a divergence in the angulation of the grinding machine 10 from a target angulation. Any detected divergence in angulation can be compensated by the manipulator.

Finally, a system for changing grinding discs of a robot-supported grinding apparatus is described. In accordance with one embodiment, the system comprises: an apparatus with a frame 31 and a separating plate 32 for removing a grinding disc 11 from a grinding machine (see FIGS. 4A-4E, 5A-5C and 6A-6E), a manipulator 1 that is configured to position and move the grinding machine 10 relative to the separating plate 32 (see FIG. 1). Here the relative movement of the grinding machine 10 and the separating plate 32 during the removal of the grinding disc is effected solely by the manipulator 1 (see e.g. FIGS. 4A-E). The apparatus with frame 31 and separating plate 32 for removal of a grinding disc therefore requires no drive of its own. In accordance with a further embodiment the system also comprises, additionally or alternatively, a hopper for receiving a stack of grinding discs, a manipulator 1 that is configured to position and move the grinding machine 10 relative to the hopper, and an actuator 20 arranged between the grinding machine 10 and the manipulator 1 that is configured to press the grinding machine 10 against the topmost grinding disc of the stack of grinding discs 11 (see FIG. 11, illustration at right). Here the relative movement between the grinding machine and the hopper is effected exclusively by the manipulator 1 (alone), or by the manipulator 1 and the actuator 20.

The apparatuses and systems described here make it possible to automatically change the grinding discs of a robot-supported grinding apparatus. One embodiment of a method relates to the automatic removal (detaching or unfastening) of a grinding disc 11 from a robot-supported grinding apparatus. In accordance with this the method includes pressing the grinding disc against a support surface (see e.g. FIGS. 4A, 6A and 7A) that is arranged essentially parallel to a separating plate 32 and carrying out a relative movement between separating plate 32 and support surface (33, 33', 33*b*), causing separating plate 32 and grinding disc 11 to move towards each other until the separating plate 32 enters the space between the grinding disc 11 and a backing pad 12 on which the grinding disc is mounted (see FIGS. 4B-C, 6B-C and 7B-C). Finally, the backing pad 12 is lifted off the support surface, thereby detaching the grinding disc 11 from the backing pad 12. A further method relates to the automatic mounting of a grinding disc 11 on a robot-supported grinding apparatus. In accordance with this the method includes aligning a backing pad 12 of a grinding machine 10 with the aid of a manipulator 1 until an underside of the backing pad 12 lies essentially parallel to a top side of a stack of grinding discs 11 (cf. FIGS. 1 and 11). The method further includes pressing the backing pad 12 against the stack of grinding discs with the aid of an actuator 20 that is coupled between the manipulator 1 and the grinding machine 10 so that the topmost grinding disc of the stack of grinding discs adheres to the backing pad 12. Finally, the grinding machine 10 lifted up, together with the grinding disc 11, with the aid of the manipulator 1 and/or the actuator 20 (see FIG. 11, illustration at right).

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof

The invention claimed is:

1. An apparatus, comprising:

a frame;

a separating plate connected to the frame;

a sensor aimed at the separating plate; and a support surface connected to the frame, wherein the separating plate and the support surface are coupled with the frame so as to allow for a relative movement between the separating plate and the support surface in a first direction, wherein the separating plate and the support surface are arranged such that when a grinding disc rests against the support surface and when the separating plate and the grinding disc move towards each other, at least one first edge of the separating plate is pushed over the grinding disc, wherein the sensor is arranged such that when the separating plate is pushed over the grinding disc, the grinding disc is between the sensor and the separating plate.

2. The apparatus of claim 1, wherein the separating plate is rigidly connected to the frame, and wherein the support surface is a carriage that is mounted to be moveable in the first direction relative to the frame.

3. The apparatus of claim 1, wherein the support surface is rigidly connected to the frame, wherein a drive is coupled between the separating plate and the frame, and wherein the drive is configured to move the separating plate relative to the support surface.

4. The apparatus of claim 1, wherein the sensor is a proximity sensor or a color sensor.

5. A method for automatically detaching a grinding disc from a robot-supported grinding apparatus, the method comprising:

pressing the grinding disc against a support surface that is arranged generally parallel to a separating plate;

carrying out a relative movement between the separating plate and the support surface so that the separating plate and the grinding disc move towards each other and the separating plate is inserted into a space between the grinding disc and a backing pad on which the grinding disc is mounted;

verifying by means of a sensor aimed at the separating plate whether the separating plate has entered the space between the grinding disc and the backing pad; and if the separating plate has entered the space between the grinding disc and the backing pad, lifting the backing pad off the support surface to remove the grinding disc from the backing pad.

6. The method of claim 5, wherein the sensor is a color sensor configured to detect the color of the separating plate, and wherein if the color of the separating plate is detected, although the separating plate should have been inserted in the space between the grinding disc and the backing pad, the relative movement is carried out at least partially in reverse in order to remove the separating plate from the space.

7. The method of claim 5, wherein pressing the grinding disc against the support surface is implemented by an actuator coupled between a grinding machine on which the grinding disc is arranged and a manipulator.

8. A system, comprising:

a grinding machine with a grinding disc to be changed;

a manipulator configured to position the grinding machine;

a linear actuator coupled between the grinding machine and the manipulator;

a first apparatus comprising a first frame, a separating plate connected to the first frame, a sensor aimed at the separating plate, and a support surface connected to the first frame, wherein the separating plate and the support surface are coupled with the first frame so as to allow for a relative movement between the separating plate and the support surface in a first direction, wherein the separating plate and the support surface are arranged such that when the grinding disc rests against the support surface and when the separating plate and the grinding disc move towards each other, at least one first edge of the separating plate is pushed over grinding disc wherein the sensor is arranged such that when the separating plate is pushed over the grinding disc, the grinding disc is between the sensor and the separating plate; and a second apparatus comprising a receiving surface configured to receive a stack of grinding discs, a second frame arranged substantially parallel to the receiving surface so that the stack of grinding discs is positioned between the receiving surface and the second frame, the second frame only partially overlapping an outer rim of a topmost grinding disc of the stack of grinding discs, and a mechanical pretensioning unit coupled with the second frame such that a defined force is exerted by the second frame on the stack of grinding discs.

* * * * *